US009051935B2

(12) United States Patent
Hossain et al.

(10) Patent No.: US 9,051,935 B2
(45) Date of Patent: Jun. 9, 2015

(54) SINGLE SCREW COMPRESSOR

(75) Inventors: Mohammod Anwar Hossain, Sakai (JP); Masanori Masuda, Sakai (JP); Hiromichi Ueno, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 252 days.

(21) Appl. No.: 13/516,924

(22) PCT Filed: Dec. 22, 2010

(86) PCT No.: PCT/JP2010/007447
§ 371 (c)(1),
(2), (4) Date: Jun. 18, 2012

(87) PCT Pub. No.: WO2011/077724
PCT Pub. Date: Jun. 30, 2011

(65) Prior Publication Data

US 2012/0258005 A1 Oct. 11, 2012

(30) Foreign Application Priority Data

Dec. 22, 2009 (JP) ..... 2009-291027
Dec. 22, 2009 (JP) ..... 2009-291153

(51) Int. Cl.
*F04B 49/22* (2006.01)
*F04C 28/24* (2006.01)
(Continued)

(52) U.S. Cl.
CPC ..... *F04C 28/24* (2013.01); *F04C 18/52* (2013.01); *F04C 28/12* (2013.01)

(58) Field of Classification Search
CPC ..... F04C 28/12; F04C 28/23; F04C 18/52
USPC ..... 418/195, 201.2; 417/213, 310
See application file for complete search history.

(56) References Cited

U.S. PATENT DOCUMENTS 4,006,603 A * 2/1977 Miles ..... 62/229
4,534,719 A * 8/1985 Zimmern ..... 418/195
7,096,681 B2 * 8/2006 Wills et al. ..... 62/175
(Continued)

FOREIGN PATENT DOCUMENTS

FR 2737754 A1 2/1997
GB 2243652 A 6/1991
(Continued)

OTHER PUBLICATIONS

European Search Report of corresponding EP Application No. 10 83 8962.8 dated May 9, 2014.
International Search Report of corresponding PCT Application No. PCT/JP2010/007447.

*Primary Examiner* — Charles Freay
(74) *Attorney, Agent, or Firm* — Global IP Counselors

(57) ABSTRACT

A single-screw compressor includes a screw rotor, a cylinder wall in which the screw rotor is rotatably accommodated, a driving mechanism which variably drives the screw rotor according to a load, and a slide valve which is provided in a slide groove formed in the cylinder wall. The slide valve faces an outer circumferential surface of the screw rotor to be movable in an axial direction, and to adjust a discharge start position by being moved in the axial direction according to the operating capacity. A discharge side end surface of the slide valve extends in a direction corresponding to a screw land of the screw rotor to which the discharge side end surface faces when the slide valve is moved to a position corresponding to a part load operation state.

5 Claims, 17 Drawing Sheets

(51) Int. Cl.
*F04C 18/52* (2006.01)
*F04C 28/12* (2006.01)

(56) References Cited

U.S. PATENT DOCUMENTS

| | | | | |
|---|---|---|---|---|
| 2003/0007873 | A1* | 1/2003 | Hattori et al. | 417/53 |
| 2006/0039805 | A1 | 2/2006 | Gotou et al. | |
| 2008/0206075 | A1* | 8/2008 | Picouet | 417/310 |

FOREIGN PATENT DOCUMENTS

| | | | |
|---|---|---|---|
| JP | 64-56592 | U | 4/1989 |
| JP | 2004-137934 | A | 5/2004 |
| JP | 2005-30362 | A | 2/2005 |
| JP | 2005-54719 | A | 3/2005 |
| JP | 4147891 | B2 | 7/2008 |
| WO | 2008/103147 | A1 | 3/2005 |
| WO | WO-2010/146793 | A1 | 12/2010 |

* cited by examiner

SINGLE SCREW COMPRESSOR

CROSS-REFERENCE TO RELATED APPLICATIONS

This U.S. National stage application claims priority under 35 U.S.C. §119(a) to Japanese Patent Application Nos. 2009-291027, filed in Japan on Dec. 22, 2009, and 2009-291153, filed in Japan on Dec. 22, 2009, the entire contents of which are hereby incorporated herein by reference.

TECHNICAL FIELD

The present invention relates to single-screw compressors, specifically relates to the structure of a slide valve of a variable VI mechanism (i.e., a volume ratio adjusting mechanism) for adjusting a ratio between a suction volume and a discharge volume a volume ratio: VI).

BACKGROUND ART

Single-screw compressors (see FIG. 9) having a compression mechanism which compresses a refrigerant by rotational movement of a screw rotor have been known. In this single-screw compressor (hereinafter referred to as a "screw compressor") (100), a gate rotor (150) meshes with a screw rotor (140) rotating in a cylinder wall (131) of a casing (130), through an opening in the cylinder wall (131), thereby forming a compression chamber (123). One end of the screw rotor (140) (i.e., the left end of the drawing) is a suction side, and the other end (i.e., the right end of the drawing) is a discharge side. When the suction side of the screw rotor (140) is closed by the gate rotor (150), a compression chamber (123) in which a low-pressure gas is sealed in a helical groove of the screw rotor (140) is formed. From there, the screw rotor (140) is further rotated, making the compression chamber (123) small, until the compression chamber (123) moves to the discharge side and communicates with a discharge opening (125). At this time, the high-pressure gas is released to the discharge side of the casing (130).

In the screw compressor (100), it is suggested to provide a slide valve (104) which moves along the axial direction of the screw rotor (140), as a variable VI mechanism (i.e., a volume ratio adjusting mechanism) (103) for adjusting a ratio between the suction volume and the discharge volume (i.e., a volume ratio:VI) (see, for example, Japanese Patent No. 4147891). The slide valve (104) is moved along the axial direction of the screw rotor (140) to change the discharge volume by changing the position from which the high-pressure gas starts to be discharged (i.e., completion of compression), thereby changing the ratio of the discharge volume to the suction volume.

The screw compressor (100) is configured to change the rotational speed of an electric motor (not shown) by controlling an inverter, thereby controlling the operating capacity. The operating capacity (i.e., the amount of refrigerant discharged per unit time) is controlled according to a load on the utilization side of the refrigerant circuit. Here, the slide valve (104) of the variable VI mechanism (103) is controlled to obtain a volume ratio (i.e., compression ratio) which can lead to optimal compression efficiency, with respect to the operating capacity controlled according to the load. Thus, the slide valve (104) moves along the axial direction of the screw rotor (140) according to the operating capacity which varies depending on whether the operation state is a rated load state (100% load) or a part load state (see FIGS. 10(A) and 10(B)).

A discharge side end surface (104*a*) of the slide valve (104) is preferably in the shape corresponding to a screw land (142) (i.e., the surface along the raised portion between the helical grooves of the screw rotor (140)) to which the discharge side end surface (104*a*) faces to reduce the pressure loss of the discharged fluid. However, the angle and the width of the screw land (142) are not uniform from the suction side to the discharge side. Therefore, to efficiently reduce the pressure loss of the discharged fluid at the time of a rated load operation (i.e., the largest operating capacity), the discharge side end surface (104*a*) of the slide valve (104) has been formed into a shape which corresponds to the inclination of the screw land (142) facing the discharge side end surface (104*a*) at the time of the rated load operation as shown in FIG. 10(A).

SUMMARY

Technical Problem

However, if the discharge side end surface (104*a*) of the slide valve (104) is formed into a shape which corresponds to the inclination of the screw land (142) facing the discharge side end surface (104*a*) at the time of rated load operation, the discharge side end surface (104*a*) of the slide valve (104) may intersect, because the above inclination is steep, with the screw land (142) which faces the discharge side end surface (104*a*) at the time of part load operation and which has a gentle inclination, as shown in FIG. 10(B). This may result in communication between adjacent compression chambers with the screw land (142) interposed therebetween at the time of part load operation, and a failure in obtaining an intended compression ratio. As a result, efficiency may be reduced.

The present invention was made in view of the above problems, and it is an objective of the invention to prevent a pressure loss of a discharged fluid and a reduction in efficiency in both of a rated load operation state and a part load operation state in a variable volume ratio single-screw compressor.

Solution to the Problem

The first aspect of the present invention is a single-screw compressor, including: a screw rotor (40) having, in an outer circumferential surface thereof, a helical groove (41) whose one end (a first end) serves as a suction side and the other end (a second end) serves as a discharge side of a fluid; a cylinder wall (31) in which the screw rotor (40) is rotaiably accommodated; a driving mechanism (26) which drives the screw rotor (40) at a variable rotational speed according to a load; and a slide valve (4) which is provided in a slide groove (33) formed in the cylinder wall (31), faces the outer circumferential surface of the screw rotor (40) to be movable in an axial direction, and adjusts a discharge start position by being moved in the axial direction according to the rotational speed, wherein a discharge side end surface (4*a*) of the slide valve (4) extends in a direction corresponding to an extending direction of a land (42) of the screw rotor (40) to which the discharge side end surface (4*a*) faces when the slide valve (4) is moved to a position corresponding to a part load operation state in which the load is lighter than a load in a rated load operation state.

In the above single-screw compressor, the slide valve (4) is moved to the discharge side in the axial direction to delay the start of discharge as the load increases. Specifically, the discharge side end surface (4*a*) of the slide valve (4) faces a portion of the land (42) of the screw rotor (40) which has a wide width and a steep inclination angle, in the rated load operation. On the other hand, in the part load operation in which the load is lighter than the load in the rated load operation, the discharge side end surface (4*a*) of the slide valve (4) faces a portion of the land (42) of the screw rotor (40) which has a narrow width and a gentle inclination angle.

In the first aspect of the present invention, the discharge side end surface (4*a*) of the slide valve (4) does not intersect with the land (42) of the screw rotor (40) to which the discharge side end surface (4*a*) faces, and adjacent compression chambers (i.e., the helical grooves (41)) do not communicate with each other in the part load operation. Further, the land (42) of the screw rotor (40) to which the discharge side end surface (4*a*) of the slide valve (4) faces in the part load operation has an inclination angle less steep than the inclination angle of the land (42) to which the discharge side end surface (4*a*) faces in the rated load operation. Thus, if the discharge side end surface (4*a*) of the slide valve (4) is formed to correspond to the inclination of the land (42) to which the discharge side end surface (4*a*) faces in the part load operation, the discharge side end surface (4*a*) of the slide valve (4) does not intersect with the land (42) to which the discharge side end surface (4*a*) faces in the rated load operation, and adjacent compression chambers (i.e., helical grooves (41)) do not communicate with each other. This means that not only in the part load operation, but also in the rated load operation, the adjacent compression chambers with the land (42) of the screw rotor (40) interposed therebetween do not communicate with each other.

The second aspect of the present invention is that in the first aspect of the present invention, the discharge side end surface (4*a*) of the slide valve (4) extends in a direction corresponding to an extending direction of the land (42) of the screw rotor (40) to which the discharge side end surface (4*a*) faces when the slide valve (4) is moved to a position corresponding to an operation state of a load factor of 50% or more and 75% or less.

The third aspect of the present invention is that in the second aspect of the present invention, the discharge side end surface (4*a*) of the slide valve (4) extends in a direction corresponding to a suction side edge of the land (42) of the screw rotor (40) to which the discharge side end surface (4*a*) faces when the slide valve (4) is moved to the position corresponding to the operation state of the load factor of 50% or more and 75% or less.

The fourth aspect of the present invention is that in the third aspect of the present invention, the discharge side end surface (4*a*) of the slide valve (4) has a curved surface corresponding to the suction side edge of the land (42) of the screw rotor (40) to which the discharge side end surface (4*a*) faces when the slide valve (4) is moved to the position corresponding to the operation state of the load factor of 50% or more and 75% or less.

Here, an annual performance factor is known as a coefficient of performance (COP) of a refrigeration apparatus. The annual performance factor is an annual COP obtained by weighting COPs in various load operations because there are heavy load operation periods, light load operation periods, middle load operation periods, etc., within a year. The annual performance factor includes, for example, an integrated part load value (IPLV) defined by Air-Conditioning and Refrigeration Institute. The IPLV is defined by the following formula $$IPLV=0.01A+0.42B+0.45C+0.12D$$

where A is a COP at a rated load (a load factor of 100%); B is a COP at a load factor of 75%; C is a COP at a load factor of 50%; and D is a COP at a load factor of 25%. This means that if the IPLVs of all the targeted chillers are averaged, 45% of annual operation time is an operation at a load factor of 50%; 42% of annual operation time is an operation at a load factor of 75%; 12% of annual operation time is an operation at a load factor of 25%; and 1% of annual operation time is an operation at a load factor of 100%.

The weighting values may be slightly different between the US and Japan, but the magnitude relationship of each of the weighting values may be generally the same between the two countries. Thus, it is still important to place importance on COPs in part load operations, and preferably, to place importance particularly COPs in the operation state of a load factor of 50% or more and 75% or less whose cumulative occurrence frequency per year is high, when obtaining the annual performance factor.

Thus, in the second to fourth aspects of the present invention, the discharge side end surface (4*a*) of the slide valve (4) is formed to extend in a direction corresponding to the land (42) of the screw rotor (40) to which the discharge side end surface (4*a*) faces in the operation state of a load factor of 50% or more and 75% or less. Thus, the pressure loss of the discharged fluid and a reduction in efficiency in the operation state of a load factor of 50% or more and 75% or less are prevented. As a result, the annual performance factor is improved.

In particular, in the third aspect of the present invention, the discharge side end surface (4*a*) of the slide valve (4) is formed to have a shape corresponding to a suction side edge of the land (42) of the screw rotor (40) to which the slide valve (4) faces in the operation state of a load factor of 50% or more and 75% or less. In the fourth aspect of the present invention, the discharge side end surface (4*a*) of the slide valve (4) is formed to have a curved surface corresponding to the suction side edge of the land (42) of the screw rotor (40) to which the slide valve (4) faces in the operation state of a load factor of 50% or more and 75% or less. By forming the discharge side end surface (4*a*) of the slide valve (4) to have the above shapes, the pressure loss of the discharged fluid and a reduction in efficiency in the operation state of a load factor of 50% or more and 75% or less are more reliably prevented, and COPs in the above load factors are further improved.

The fifth aspect of the present invention is that in the first aspect of the present invention, the discharge side end surface (4*a*) of the slide valve (4) extends in a direction corresponding to an extending direction of a narrow portion (42*a*) of the land (42) of the screw rotor (40) at which the land (42) has a narrowest width.

In the fifth aspect of the present invention, the narrow portion (42*a*) of the land (42) of the screw rotor (40) whose width and angle are not uniform has a narrower width and a less steep inclination angle than the other portion of the land (42). Thus, if the discharge side end surface (4*a*) of the slide valve (4) is formed to extend in a direction corresponding to the extending direction of the narrow portion (42*a*) of the land (42) of the screw rotor (40), the discharge side end surface (4*a*) of the slide valve (4) does not intersect with the land (42) whichever portion of the land (42) of the screw rotor (40) the discharge side end surface (4*a*) faces. Accordingly, adjacent compression chambers (i.e., helical grooves (41)) do not communicate with each other.

Advantages of the Invention

According to the present invention, it is possible to prevent communication between adjacent compression chambers with the land (42) of the screw rotor (40) interposed therebetween, in both of the rated load operation state and the part load operation state. Thus, it is possible to prevent the pressure loss of a discharged fluid and a reduction in efficiency in the part load operation and the rated load operation.

Further, according to the second to fourth aspects of the present invention, it is possible to reliably prevent the pressure loss of the discharged fluid and a reduction in efficiency, particularly in the operation state of a load factor of 50% or more and 75% or less whose cumulative occurrence frequency per year is high. As a result, the annual performance factor can be improved and annual power consumption can be significantly reduced.

According to the fifth aspect of the present invention, the pressure loss of the discharged fluid and a reduction in efficiency can be prevented in the entire range of movement of the slide valve (4). Thus, it is possible to prevent the pressure loss of the discharged fluid and a reduction in efficiency in the part load operation and the rated load operation.

BRIEF DESCRIPTION OF THE DRAWINGS

FIG. 6(A) shows an operation state of a rated load. FIG. 6(B) shows an operation state of a load factor of 75%. FIG. 6(C) shows an operation state of a load factor of 50%. FIG. 6(D) shows an operation state of a load factor of 25%.

FIG. 7(A) shows a suction phase. FIG. 7(B) shows a compression phase. FIG. 7(C) shows a discharge phase.

FIG. 10(A) shows an operation state of a rated load. FIG. 10(B) shows an operation state of a part load.

FIG. 16(A) shows an operation state of a rated load. FIG. 16(B) shows an operation state of 75% load. FIG. 16(C) shows an operation state of 50% load. FIG. 16(D) shows an operation state of 25% load.

FIG. 17(A) shows a suction phase, FIG. 17(B) shows a compression phase. FIG. 17(C) shows a discharge phase.

DESCRIPTION OF EMBODIMENTS

Embodiments of the present invention will be described in detail below based on the drawings.

<<The First Embodiment of Invention>>

A single-screw compressor (1) (hereinafter simply referred to as a "screw compressor") of the present first embodiment is provided in a refrigerant circuit which performs a refrigeration cycle to compress a refrigerant.

The screw compressor (1) includes a compression mechanism (20) and a variable VI mechanism (i.e., a volume ratio adjusting mechanism) (3) for adjusting a ratio between the suction volume and the discharge volume (i.e., a volume ratio:VI) of the compression mechanism (20).

<Compression Mechanism>

Figure 1:
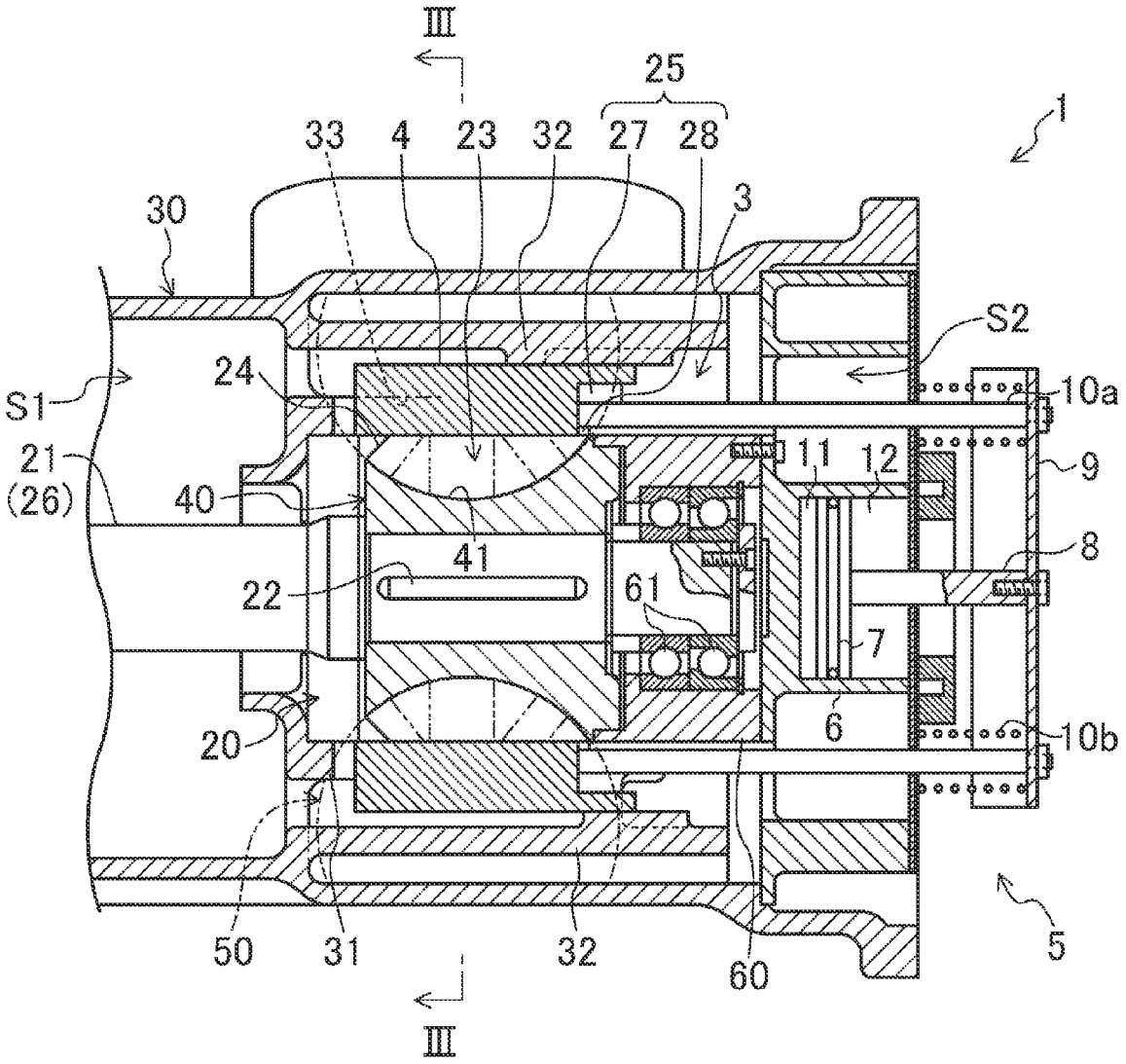
FIG. 1 is a vertical cross-section showing a structure of a main part of a screw compressor according to the first embodiment of the present invention, in a high VI operation state corresponding to a rated load.
Figure 2:
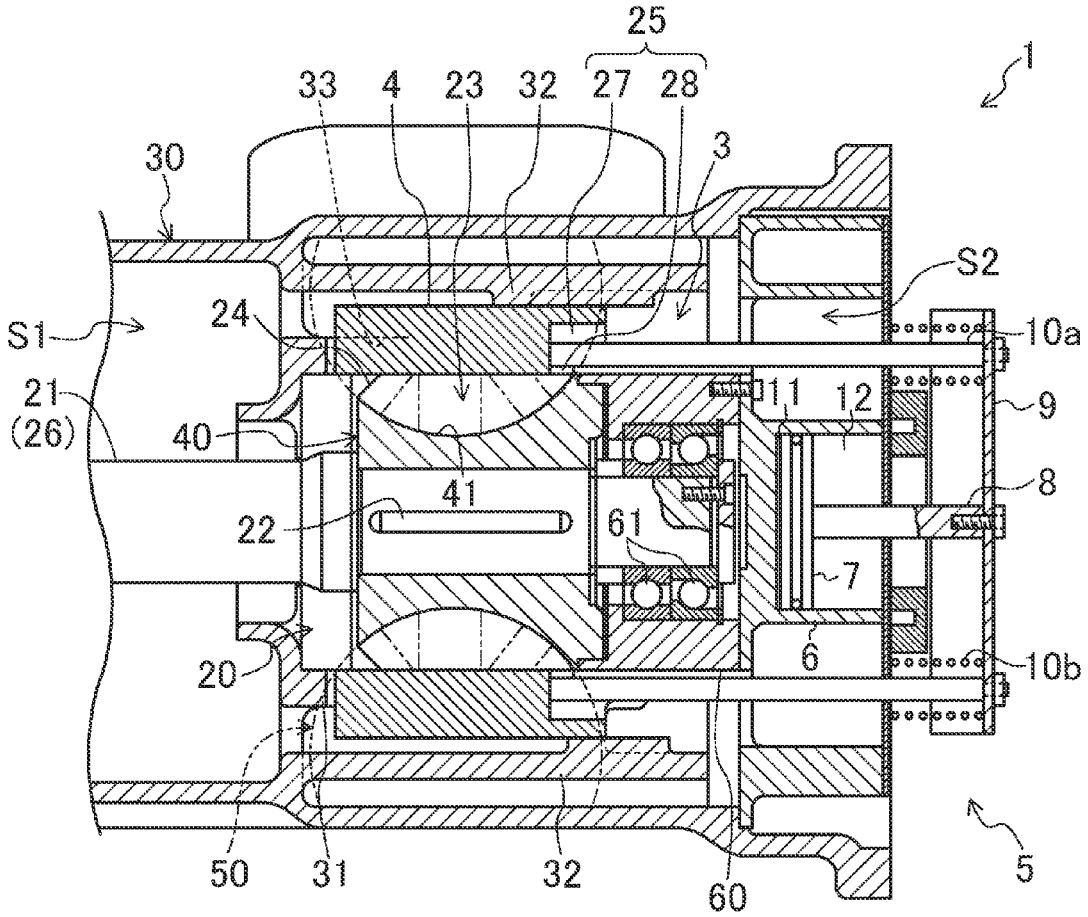
FIG. 2 is a vertical cross-section showing the structure of the main part of the screw compressor in FIG. 1, in a low VI operation state corresponding to a part load.
Figure 3:
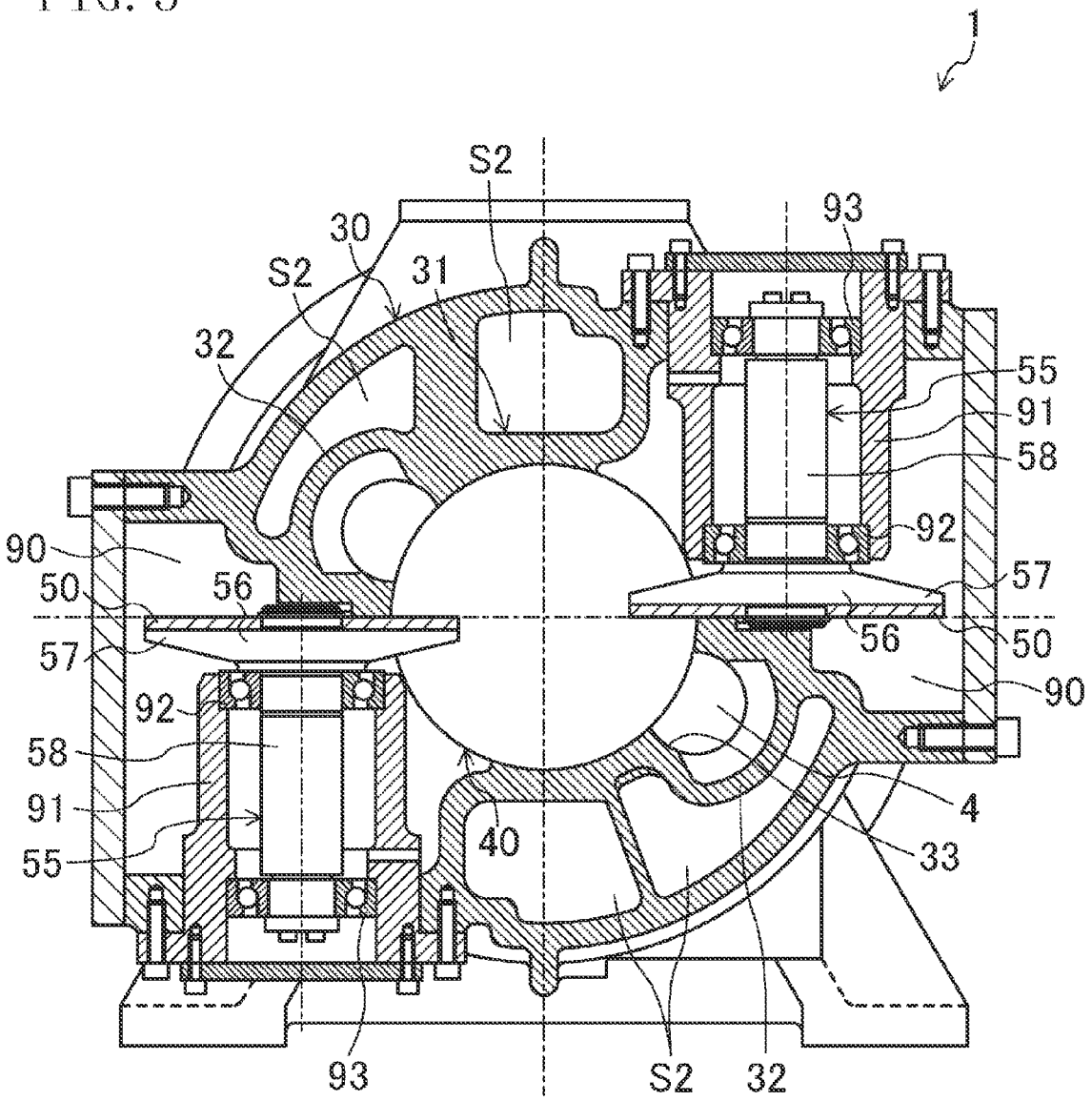
FIG. 3 is a lateral cross-section taken along the line III-III of FIG. 1.

The compression mechanism (20) includes a cylinder wall (31) formed in a casing (30) of the screw compressor (1), one screw rotor (40) rotatably provided in the cylinder wall (31), and two gate rotors (50) which mesh with the screw rotor (40) as shown in FIGS. 1-3.

A suction space (S1) facing a suction opening (24) of the compression mechanism (20), and a discharge space (S2) facing a discharge opening (25) of the compression mechanism (20) are formed in the casing (30). The cylinder wall (31) is provided with two communicating portions (32) along a circumferential direction of the cylinder wall (31), which protrude outward from the circumferential direction of the cylinder wall (31) for communicating the suction space (S1) and the discharge space (S2). Each of the communicating portions (32) includes a slide groove (33) which extends along the axial direction of the cylinder wall (31). A slide valve (4), described later, is fitted in the slide groove (33) to be movable in the axial direction. The slide groove (33) and the slide valve (4) form the variable VI mechanism (3). The discharge opening (25) includes a valve-side discharge opening (27) formed at the slide valve (4), and a cylinder-side discharge opening (28) formed at the cylinder wall (31).

A drive shaft (21) which extends from an electric motor (not shown) is inserted in the screw rotor (40). The screw rotor (40) and the drive shaft (21) are coupled with a key (22), so that the screw rotor (40) is driven by a driving mechanism (26) which includes the electric motor and the drive shaft (21). The drive shaft (21) is arranged coaxially with the screw rotor (40). A tip end of the drive shaft (21) is rotatably supported by a bearing holder (60) provided on a discharge side of the compression mechanism (20) (on the right side of the compression mechanism, provided that the axial direction of the drive shaft (21) in FIG. 1 is a right-left direction). The bearing holder (60) supports the drive shaft (21) through ball bearings (61). The screw rotor (40) is rotatably fitted to the cylinder wall (31), and the outer circumferential surface of the screw rotor (40) slides on the inner circumferential surface of the cylinder wall (31) with an oil film interposed therebetween.

The rotational speed of the electric motor can be adjusted by controlling an inverter. Thus, the operating capacity of the screw compressor (1) can be changed by adjusting the rotational speed of the electric motor. The operating capacity of the screw compressor (I) (i.e., the amount of refrigerant discharged per unit time) is controlled according to a load on the utilization side of the refrigerant circuit. The slide valve (4) of the variable VI mechanism (3) is controlled to obtain a volume ratio (i.e., the compression ratio) which can lead to optimal compression efficiency, with respect to the operating capacity controlled according to the load. Specifically, the slide valve (4) moves in the axial direction of the screw rotor (40) according to the operating capacity which varies depending on whether the operation state is a rated load state (i.e., the state in which a load factor is 100%) or a part load state (i.e., the state in which the load factor is less than 100%). In the screw compressor (1), if the rated load operation state (the state shown in FIG. 1) and the part load operation state (the state as shown in FIG. 2) are compared, the position of the slide valve (4) is more to the left of FIG. 1 (i.e., to the suction side) in the operation state of a lighter load, to increase the area of the cylinder-side discharge opening (28).

Figure 4:
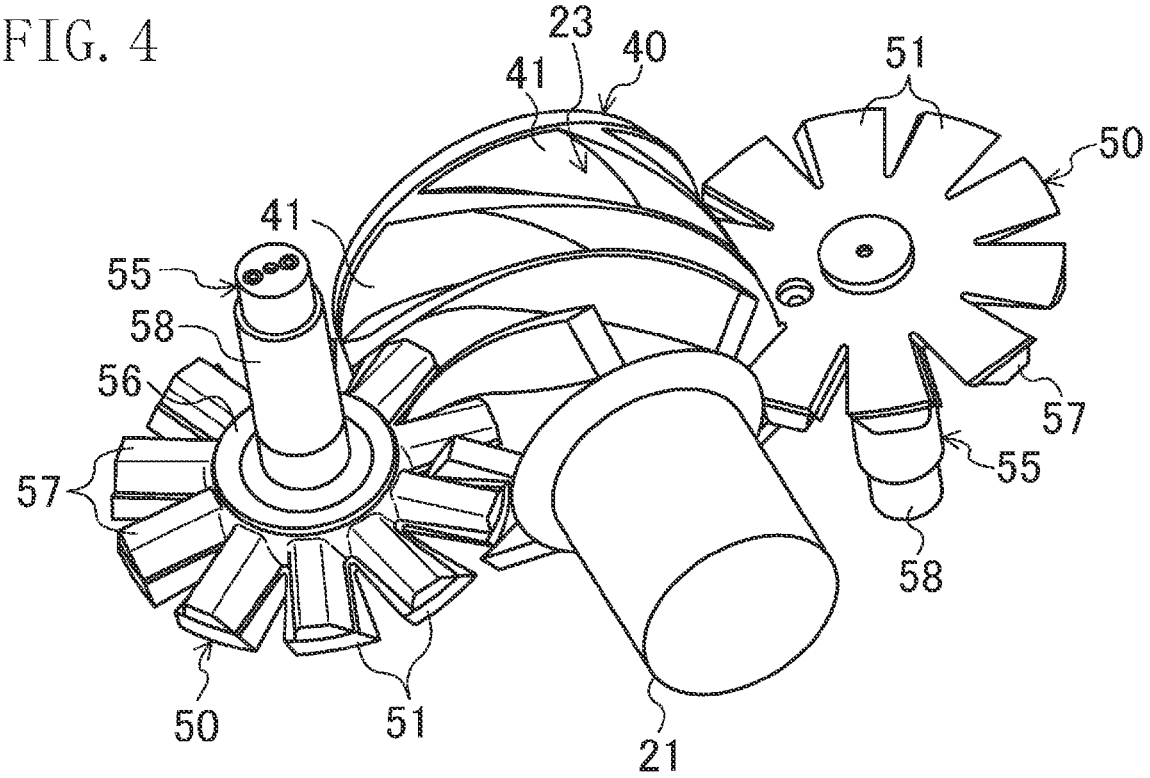
FIG. 4 is an oblique view focusing on the main part of the screw compressor.
Figure 5:
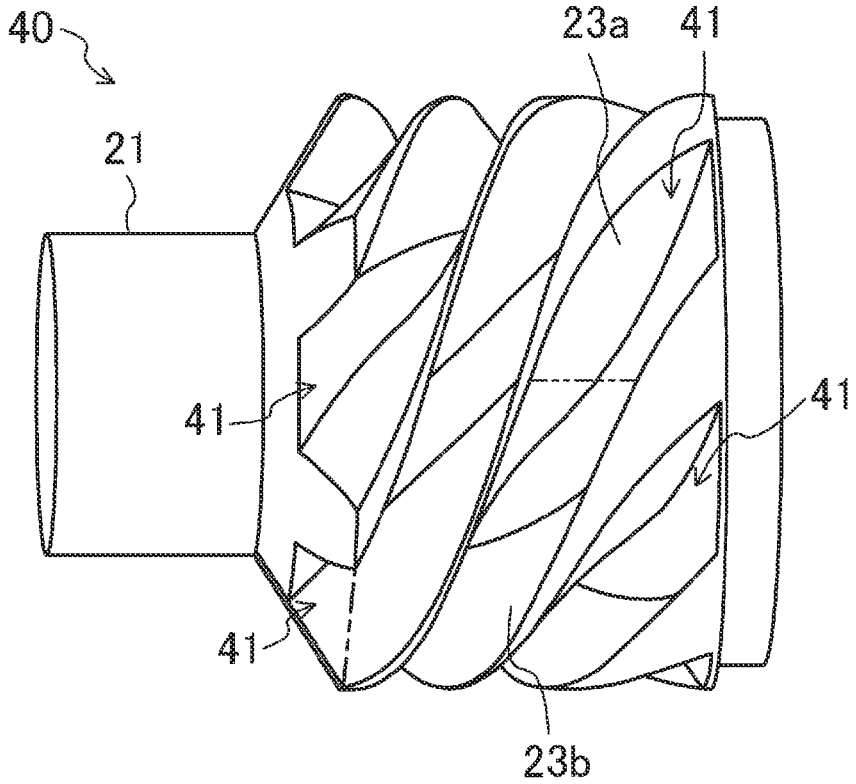
FIG. 5 is an oblique view showing the screw rotor of the screw compressor.

The screw rotor (40) shown in FIG. 4 and FIG. 5 is a metal member having a substantially columnar shape. The screw rotor (40) includes, in its outer circumferential surface, a plurality of helical grooves (41) (six helical grooves in the first embodiment) which extend helically from one end (the end portion on the fluid (refrigerant) suction side) to the other end (the end portion on the discharge side) of the screw rotor (40).

In each of the helical grooves (41) of the screw rotor (40), the left end in FIG. 5 (the end portion of the suction side) is a start end, and the right end in FIG. 5 is a terminal end (the side from which a fluid is discharged). The left end portion of the screw rotor (40) is tapered as shown in FIG. 5. In the screw rotor (40) shown in FIG. 5, the start ends of the helical grooves (41) are open in the tapered left end surface, but the terminal ends of the helical grooves (41) are not open in the right end surface of the screw rotor (40).

Each of the gate rotors (50) is a member made of resin. The gate rotor (50) has a plurality of radially arranged, rectangular plate-shaped gates (51) (11 gates in the first embodiment). The gate rotors (50) are arranged outside the cylinder wall (31) to be axially symmetric with the axis of rotation of the screw rotor (40). That is, in the screw compressor (1) of the present first embodiment, the two gate rotors (50) are arranged equal angular intervals about the axis of rotation of the screw rotor (40) (at 180° intervals in the present first embodiment). A shaft center of each gate rotor (50) is perpendicular to a shaft center of the screw rotor (40). Each gate rotor (50) is arranged such that the gates (51) penetrate part (not shown) of the cylinder wall (31) to mesh with the helical grooves (41) of the screw rotor (40).

The gate rotors (50) are attached to metal rotor supports (55), respectively (see FIG. 4). Each of the rotor supports (55) includes a base (56), arms (57), and a shaft (58). The base (56) is in the shape of a slightly thick disc. The number of the arms (57) is the same as the number of the gates (51) of the gate rotor (50), and the arms (57) extend radially outward from an outer circumferential surface of the base (56). The shaft (58) is in the shape of a rod, and is placed to stand on the base (56). A center axis of the shaft (58) coincides with a center axis of the base (56). The gate rotor (50) is attached to the base (56) and the arms (57) on the side opposite to the shaft (58). The arms (57) are in contact with rear surfaces of the gates (51), respectively.

Each of the rotor supports (55) to which the gate rotor (50) is attached is placed in a gate rotor chamber (90) provided adjacent to the cylinder wall (31) in the casing (30) (see FIG. 3). The rotor support (55) on the right of the screw rotor (40) in FIG. 3 is arranged, with the gate rotor (50) facing downward. The rotor support (55) on the left of the screw rotor (40) in FIG. 3 is arranged, with the gate rotor (50) facing upward. The shaft (58) of each of the rotor supports (55) is rotatably supported by a bearing housing (91) in the gate rotor chamber (90) through ball bearings (92, 93). Each of the gate rotor chambers (90) communicates with the suction space (S1).

In the compression mechanism (20), the space surrounded by the inner circumferential surface of the cylinder wall (31), the helical grooves (41) of the screw rotor (40), and the gates (51) of the gate rotors (50) forms the compression chamber (23). The compression chamber (23) includes a first compression chamber (23*a*) located above the horizontal central line in FIG. 3, and a second compression chamber (23*b*) below the central line (see FIG. 5). The suction side edges of the helical grooves (41) of the screw rotor (40) are open to the suction space (S1), and this open area is the suction opening (24) of the compression mechanism (20).

<Variable VI Mechanism (Volume Ratio Adjusting Mechanism)>

The variable VI mechanism (3) includes a hydraulic cylinder (5) which is fixed to the discharge side of the bearing holder (60) and located in the discharge space (S2), in addition to the slide groove (33) of the communicating portion (32) provided on the cylinder wall (31), and the slide valve (4) slidably fitted in the slide groove (33) (see FIGS. 1 and 2).

The slide valve (4) is provided in each of the first and second compression chambers 23*a*, 23*b*). As described above, the slide valve (4) and the cylinder wall (31) are provided with the valve-side discharge opening (27) and the cylinder-side discharge opening (28), respectively, which form the discharge opening (25) of the compression mechanism (20). The compression chamber (23) and the discharge space (S2) communicate with each other through the discharge opening (25). The inner surface of the slide valve (4) forms part of the inner circumferential surface of the cylinder wall (31), and the slide valve (4) is configured to be slidable in the direction of the shaft center of the cylinder wall (31). One end of the slide valve (4) faces the discharge space (S2), and the other end of the slide valve (4) faces the suction space (S1).

The hydraulic cylinder (5) includes a cylinder tube (6), a piston (7) inserted in the cylinder tube (6), an arm (9) coupled to a piston rod (8) of the piston (7), a coupling rod (10*a*) which couples the arm (9) and the slide valve (4), and a spring (10*b*) which biases the arm (9) to the right in FIG. 1 (to the direction in which the arm (9) is separated from the casing (30)). On both sides of the piston (7) in the cylinder tube (6), a first cylinder space (11) (on the left side of the piston (7) in FIG. 1) and a second cylinder space (12) (on the right side of the piston (7) in FIG. 1) are formed. The hydraulic cylinder (5) is configured to adjust the position of the slide valve (4) by adjusting the pressures of the cylinder spaces (11, 12) on the right and left sides of the piston (7).

When the slide valve (4) slides, the size of the discharge opening (25) is changed, and a terminal position of a compression phase (or a start position of a discharge phase) is changed. For example, FIG. 1 shows the state in which the slide valve (4) slides to the right. In this state, the discharge opening (25) is open substantially at the terminal end of the helical grooves (41). This state corresponds to the rated load operation state (a high VI operation state). When the screw compressor (1) is in this state, discharge is performed at the latest timing, and the compression ratio is largest.

FIG. 2 shows the state in which the slide valve (4) slides to the left. In this state, the discharge opening (25) is open at a location near the middle of the helical groove (41). This state corresponds to the part load operation state (a low VI operation state). In this state, discharge is performed earlier than the discharge performed in the high VI operation state (see FIG. 1), and the compression ratio is smaller than the compression ratio in the high VI operation state.

In the present first embodiment, an optimal VI value is selected to maximize the efficiency of the screw compressor (1) according to the operation state of the refrigerant circuit, and the position of the slide valve (4) is thereby adjusted. Here, a control mechanism (not shown) controls the capacity by controlling the rotational frequency of the electric motor by an inverter, according to the operation state (a load on the utilization side).

The slide valve (4) is provided with a rotation block (not shown) in order that the inner circumferential surface of the slide valve (4) slides on the outer circumferential surface of a valve guide (15) wherever the position of the slide valve (4) is during the operation. Thus, the inner circumferential surface of the slide valve (4) is maintained in a position where the inner circumferential surface of the slide valve (4) and the inner circumferential surface of the cylinder wall (31) of the casing (30) forms the same cylinder surface. Accordingly, in the present first embodiment, the slide valve (4) does not rotate, and the inner circumferential surface of the slide valve (4) does not interfere with the outer circumferential surface of the screw rotor (40).

On the other hand, the cylinder-side discharge opening (28) included the discharge opening (25) includes a main discharge port (28*a*) and auxiliary discharge ports (28*b*, 28*c*, 28*d*) as shown in FIG. 6(A)-FIG. 6(D). The shape of the opening of the main discharge port (28*a*) is determined according to the position of the slide valve (4) in the rated load operation state, and as shown in FIG. 6(A)-FIG. 6(D), the main discharge port (28*a*) is open in both of the rated load operation state and the part load operation state, without being closed by the slide valve (4), and allows a fluid to be discharged. The shapes of the openings of the auxiliary discharge ports (28*b*, 28*c*, 28*d*) are determined according to the position of the slide valve (4) in the part load operation state. The auxiliary discharge ports (28*b*, 28*c*, 28*d*) are closed by the slide valve (4) in the rated load operation state, and are opened from the slide valve (4) in the part load operation state to allow a fluid to be discharged.

In the present first embodiment, a plurality of ports corresponding to a plurality of part load operation states are provided as the auxiliary discharge ports (28*b*, 28*c*, 28*d*). Specifically, the auxiliary discharge ports (28*b*, 28*c*, 28*d*) are three ports which correspond to the operation states of a 75% load factor, a 50% load factor, and a 25% load factor. The main discharge port (28*a*) and the auxiliary discharge ports (28*b*, 28*c*, 28*d*) are separated from one another.

Figure 6:
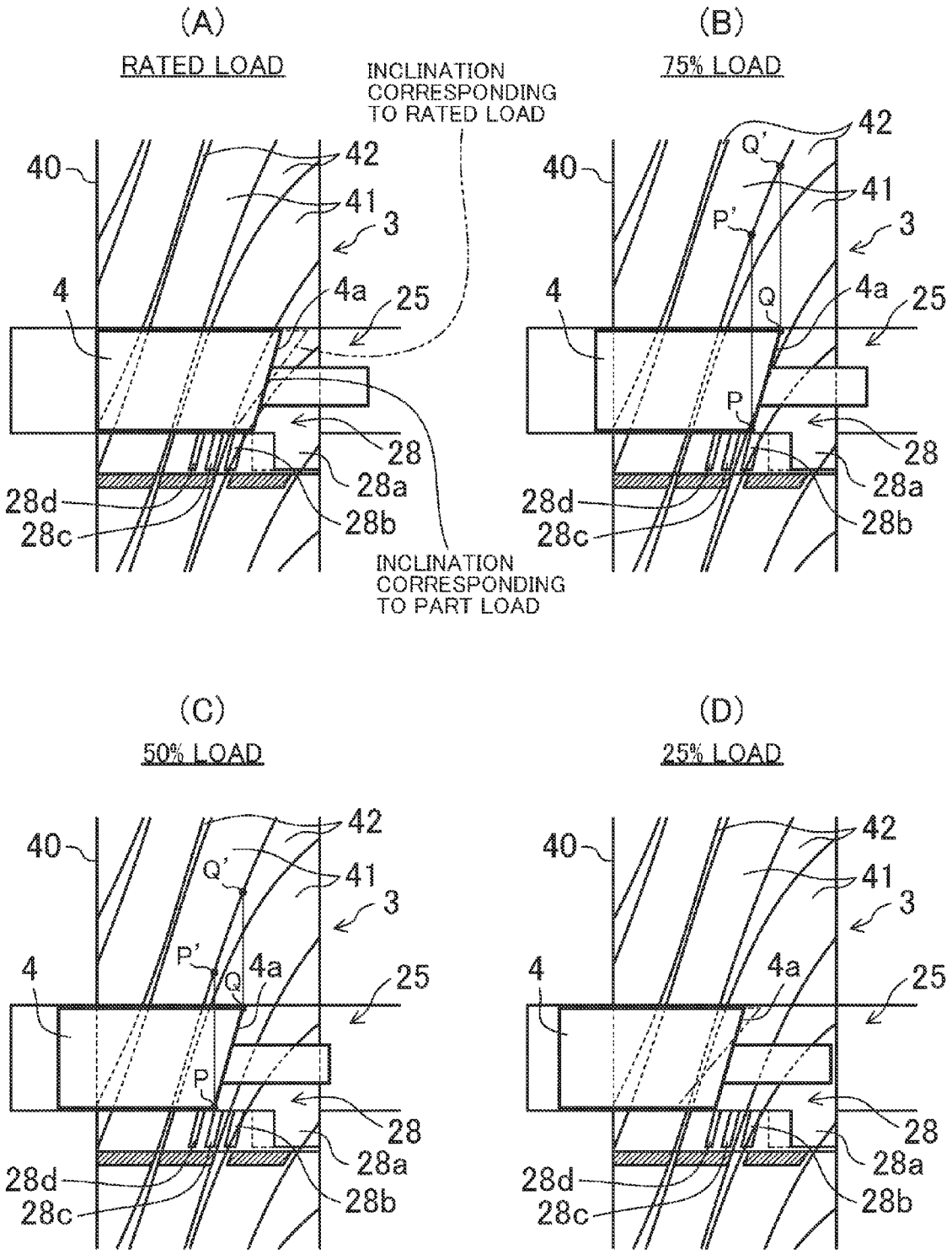
FIG. 6 shows developed views illustrating the working state of the slide valve.

FIG. 6(A)-FIG. 6(D) show the positional relationships between the slide valve (4) and the cylinder-side discharge opening (28), with the screw rotor (40) developed. The auxiliary discharge port (28*h*) (referred to as a first auxiliary discharge port (28*b*)) which corresponds to the operation state of a 75% load factor is provided at a location at which the auxiliary discharge port (28*b*) is closed by the slide valve (4) in the rated load operation state as shown in FIG. 6(A), and is open in the operation states of a 75% load factor, a 50% load factor, and a 25% load factor as shown in FIG. 6(B)-FIG. 6(D). The auxiliary discharge port (28*c*) (referred to as a second auxiliary discharge port (28*c*)) which corresponds to the operation state of a 50% load factor is provided at a location at which the auxiliary discharge port (28*c*) is closed by the slide valve (4) in the rated load operation state and the operation state of a 75% load factor as shown in FIG. 6(A) and FIG. 6(B), and is open in the operation states of a 50% load factor and a 25% load factor as shown in FIG. 6(C) and FIG. 6(D). Further, the auxiliary discharge port (28*d*) (referred to as a third auxiliary discharge port (28*d*)) which corresponds to the operation state of a 25% load factor is provided at a location at which the auxiliary discharge port (28*d*) is closed by slide valve (4) in the rated load operation state and the operation states of a 75% load factor and a 50% load factor as shown in FIG. 6(A)-FIG. 6(C), and is open in the operation state of a 25% load factor as shown in FIG. 6(D).

The discharge side end surface (4*a*) of the slide valve (4) is configured to extend in a direction corresponding to an extending direction of the screw land (42) (i.e., the surface along the raised portion between the helical grooves (41) of the screw rotor (40)) to which the slide valve (4) faces in the part load operation state. Specifically, in the present first embodiment, the inclination of the discharge side end surface (4*a*) of the slide valve (4) is decided based on the inclination of the screw land (42) facing the slide valve (4) in the operation state of a load factor of 50% or more and 75% or less as shown in FIG. 6(B) and FIG. 6(C) (this inclination of the screw land (42) corresponds to a line segment P'Q' between the points P' and Q' which are the projection of two points P and Q located at corners of the discharge side end surface (4*a*) shown in FIG. 6(B) and FIG. 6(C), on the suction side edge of the screw land (42) in a direction perpendicular to the axis). Thus, when the screw rotor (40) is rotated and the line segment P'Q' on the suction side edge of the screw land (42) comes to the position of the discharge side end surface (4*a*) of the slide valve (4), the line segment P'Q' coincides with the line segment PQ. Further, the side surfaces of the auxiliary discharge ports (28*b*, 28*c*, 28*d*) are tilted to align with the inclination of the discharge side end surface (4*a*) of the slide valve (4).

The width of each of the auxiliary discharge ports (28*b*, 28*c*, 28*d*) is narrower than the width of the portion of the screw land (42) (the portion corresponding to the line segment P'Q') based on which the inclination of the discharge side end surface (4*a*) of the slide valve (4) is decided. Further, the widths of the plurality of auxiliary discharge ports (28*b*, 28*c*, 28*d*) are reduced sequentially from the discharge side to the suction side. The widths of the auxiliary discharge ports (28*b*, 28*c*, 28*d*) are reduced from the discharge side to the suction side in accordance with the width of the screw land (42) to which the discharge side end surface (4*a*) of the slide valve (4) faces, the width of the screw land (42) being reduced from the discharge side to the suction side within the range of movement of the slide valve (4) as shown in FIG. 6(A)-FIG. 6(D).

The reason why the discharge side end surface (4*a*) of the slide valve (4) is tilted to coincide with the inclination of the suction side edge of the screw land (42) to which the discharge side end surface (4*a*) faces in the operation state of a load factor of 50% or more and 75% or less as described above will be described below.

First, an annual performance factor is known as a coefficient of performance (COP) of a refrigeration apparatus. The annual performance factor is an annual COP obtained by weighting COPs in various load operations because there are heavy load operation periods, light load operation periods, middle load operation periods, etc., within a year. The annual performance factor includes, for example, an integrated part load value (IPLV) defined by Air-Conditioning and Refrigeration Institute. The IPLV is defined by the following formula $$IPLV=0.01A+0.42B+0.45C+0.12D$$

where A is a COP at a rated load (a load factor of 100%); B is a COP at a load factor of 75%; C is a COP at a load factor of 50%; and D is a COP at a load factor of 25%. This means that if the IPLVs of all the targeted chillers are averaged, 45% of annual operation time is an operation at a load factor of 50%; 42% of annual operation time is an operation at a load factor of 75%; 12% of annual operation time is an operation at a load factor of 25%; and 1% of annual operation time is an operation at a load factor of 100%.

The weighting values may be slightly different between the US and Japan, but the magnitude relationship of each of the weighting values may be generally the same between the two countries. Thus, it is still important to place importance on COPs in part load operations, and preferably, to place importance particularly on COPs in the operation state of a load factor of 50% or more and 75% or less whose cumulative occurrence frequency per year is high, when obtaining the annual performance factor.

Thus, in the present first embodiment, the discharge side end surface (4*a*) of the slide valve (4) is configured to have a shape corresponding to the suction side edge of the screw rotor (40) to which the discharge side end surface (4*a*) of the slide valve (4) faces in the operation state of a load factor of 50% or more and 75% or less. As a result, it is possible to prevent the discharge side end surface (4*a*) of the slide valve (4) from intersecting with the screw land (42) facing the discharge side end surface (4*a*), and prevent the adjacent compression chambers (23), with the screw land (42) interposed therebetween, from communicating with each other with reliability. As a result, a discharge resistance is reduced, and it is possible to prevent a pressure loss of the discharged refrigerant and a reduction in efficiency. In the present first embodiment, COPs in the operation state of a load factor of 50% or more and 75% or less are improved to increase the annual performance factor.

—Working Mechanism—

Working mechanisms of the compression mechanism (20) and the variable VI mechanism (3) of the screw compressor (1) will be described.

<Compression Mechanism>

Figure 7:
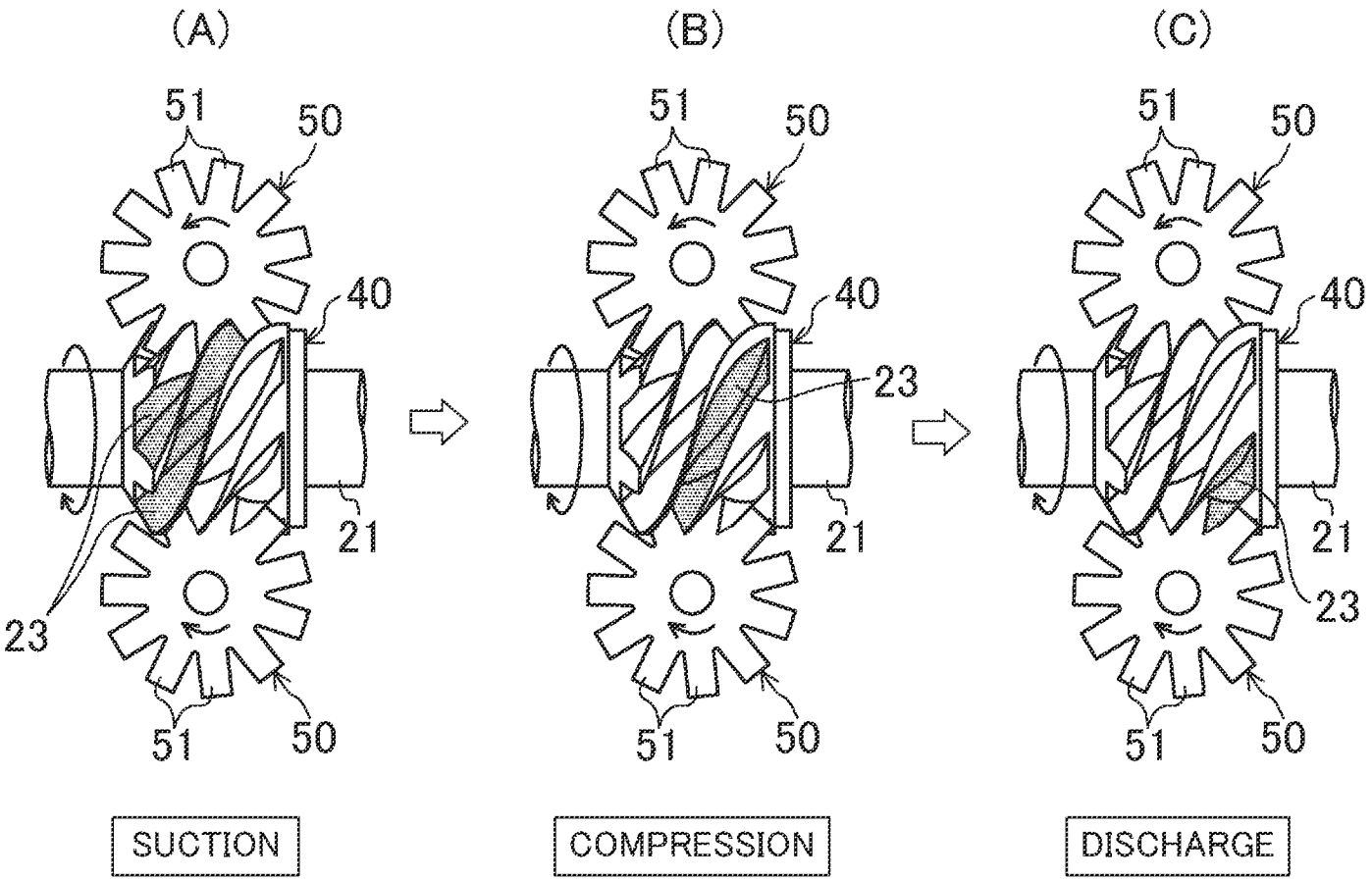
FIG. 7 shows plan views illustrating working mechanisms of a compression mechanism of the screw compressor.

When the electric motor is activated, the drive shaft (21) is rotated to rotate the screw rotor (40). As the screw rotor (40) is rotated, the gate rotors (50) are also rotated, and a suction phase, a compression phase, and a discharge phase of the compression mechanism (20) are repeated. In the following description, the compression chamber (23) which is shaded in FIG. 7 will be described.

In FIG. 7(A), the shaded compression chamber (23) communicates with the suction space (S1). The helical groove (41) constituting the compression chamber (23) meshes with the gates (51) of the lower gate rotor (50) shown in FIG. 7(A). When the screw rotor (40) is rotated, the gate (S1) relatively moves toward the terminal end of the helical groove (41), thereby increasing the volume of the compression chamber (23). Thus, the low-pressure gas refrigerant in the suction space (S1) is sucked into the compression chamber (23) through the suction opening (24).

When the screw rotor (40) is further rotated, the compression chamber (23) is in the state shown in FIG. 7(B). As shown in FIG. 7(B), the shaded compression chamber (23) is completely closed. Thus, the helical groove (41) constituting the compression chamber (23) meshes with the gate (51) of the upper gate rotor (50) shown in FIG. 7(B), and is separated from the suction space (S1) by the gate (51). When the gate (51) moves toward the terminal end of the helical grooves (41) as the screw rotor (40) is rotated, the volume of the compression chamber (23) gradually decreases. Thus, the gas refrigerant in the compression chamber (23) is compressed.

When the screw rotor (40) is further rotated, the compression chamber (23) is in the state shown in FIG. 7(C). In FIG. 7(C), the shaded compression chamber (23) communicates with the discharge space (S2) through the discharge opening (25). When the gate (51) moves toward the terminal end of the helical groove (41) as the screw rotor (40) is rotated, the compressed refrigerant gas is pushed out of the compression chamber (23) to the discharge space (S2).

<Variable VI Mechanism (Volume Ratio Adjusting Mechanism)>

Next, an operation of the variable VI mechanism (3) will be described.

As described above, when the slide valve (4) slides to adjust the operating capacity of the screw compressor (1), the discharge start position at the discharge opening (25) is changed. As a result, the size of the discharge opening (25) is changed, and a terminal position of a compression phase (or a start position of a discharge phase) is changed.

FIG. 1 shows the state in which the slide valve (4) slides to the right. In this state, the discharge opening (25) is open at a location almost near the terminal end of the helical groove (41). This state is a high VI operation state which corresponds to the rated load operation of the refrigeration apparatus. This state of the screw compressor (1) is a state in which discharge is performed at the latest timing, and the compression ratio is the largest.

FIG. 2 shows the state which the slide valve (4) slides to the left. In this state, the discharge opening (25) is open at a location near the middle of the helical groove (41). This state is a low VI operation state which corresponds to the part load operation of the refrigeration apparatus. In this state, discharge is performed earlier than the discharge performed in the high VI operation state (see FIG. 1), and the compression ratio is smaller than the compression ratio in the high VI operation state.

Here, in the state shown in FIG. 6(A) in which the slide valve (4) is located at a position corresponding to the rated load operation state, all the three auxiliary discharge ports (28*b*, 28*c*, 28*d*) are closed by the slide valve (4), and the main discharge port (28*a*) is open without being closed by the slide valve (4). The refrigerant compressed in the compression chamber (23) flows out to the discharge space (S2) through the main discharge port (28*a*).

In the state shown in FIG. 6(B) in which the slide valve (4) is located at a position corresponding to the operation state of a load factor of 75%, the second auxiliary discharge port (28*c*) and the third auxiliary discharge port (28*d*) are closed by the slide valve (4), and the main discharge port (28*a*) and the first auxiliary discharge port (28*b*) are open without being closed by the slide valve (4). The refrigerant compressed in the compression chamber (23) flows out to the discharge space (S2) through the main discharge port (28*a*) and the first auxiliary discharge port (28*b*).

In the state shown in FIG. 6(C) in which the slide valve (4) is located at a position corresponding to the operation state of a load factor of 50%, the third auxiliary discharge port (28*d*) is closed by the slide valve (4), and the main discharge port (28*a*), the first auxiliary discharge port (28*b*), and the second auxiliary discharge port (28*c*) are open without being closed by the slide valve (4). The refrigerant compressed in the compression chamber (23) flows out to the discharge space (S2) through the main discharge port (28*a*), the first auxiliary discharge port (28*b*), and the second auxiliary discharge port (28*c*).

In the state shown in FIG. 6(D) in which the slide valve (4) is located at a position corresponding to the operation state of a load factor of 25%, all of the main discharge port (28*a*), the first auxiliary discharge port (28*b*), the second auxiliary discharge port (28*c*), and the third auxiliary discharge port (28*d*) are open without being closed by the slide valve (4). The refrigerant compressed in the compression chamber (23) flows out to the discharge space (S2) through the main discharge port (28*a*), the first auxiliary discharge port (28*b*), the second auxiliary discharge port (28*c*), and the third auxiliary discharge port (28*d*).

In the present first embodiment, the refrigerant is discharged not only from the main discharge port (28*a*), but also from the corresponding auxiliary discharge ports (28*b*, 28*c*, 28*d*) in all of the plurality of part load operation states. Thus, the discharge resistance is reduced, and as a result, the pressure loss is reduced.

The width of the screw land (42) to which the discharge side end surface (4*a*) of the slide valve (4) faces is increased from the suction side to the discharge side, and the inclination angle of the screw land (42) becomes steeper from the suction side to the discharge side, within the range of movement of the slide valve (4). That is, the width of the screw land (42) is wider, and the inclination of the screw land (42) is steeper, at a portion to which the discharge side end surface (4*a*) of the slide valve (4) faces in the rated load operation, than a portion to which the discharge side end surface (4*a*) of the slide valve (4) faces in the part load operation. Thus, if the discharge side end surface (4*a*) of the slide valve (4) is formed to correspond to the inclination of the suction side edge of the screw land (42) to which the discharge side end surface (4*a*) of the slide valve (4) faces in the rated load operation (see the phantom line in FIG. 6(A)), the inclination of the discharge side end surface (4*a*) becomes steeper, and it may result in communication between the adjacent compression chambers (23) when the operation state changes to the part load operation state, as indicated by the phantom line in FIG. 6(D). If the adjacent compression chambers (23) communicate with each other, an intended compression ratio cannot be obtained.

Thus, in the present first embodiment, the discharge side end surface (4*a*) of the slide valve (4) is inclined to correspond to the inclination of the suction side edge of the screw land (42) (i.e., the inclination of the line segment P'Q') to which the discharge side end surface (4*a*) faces in the part load operation state, particularly in the operation state of a load factor of 50% or more and 75% or less whose cumulative occurrence frequency per year is high. Accordingly, the discharge side end surface (4*a*) of the slide valve (4) does not intersect with the screw land (42) to which the discharge side end surface (4*a*) faces when the slide valve (4) is moved to a position corresponding to the operation state of a load factor of 50% or more and 75% or less. Further, the discharge side end surface (4*a*) of the slide valve (4) does not intersect with the screw land (42) to which the discharge side end surface (4*a*) faces when the slide valve (4) is moved to a position corresponding to an operation state of a load factor larger than the above predetermined load factor (i.e., the predetermined load factor or more and a load factor of 100% or less). Thus, in the present first embodiment, the adjacent helical grooves (41) (i.e., the compression chambers (23)) do not communicate with each other both in the part load operation (i.e., a load factor of 50% or more and a load factor of 75% or less) and in the rated load operation (i.e., a load factor of 100%).

—Advantages of First Embodiment—

According to the present first embodiment, the discharge side end surface (4*a*) of the slide valve (4) is formed to have a shape corresponding to the inclination of the screw land (42) to which the discharge side end surface (4*a*) faces in the part load operation. Thus, the discharge side end surface (4*a*) of the slide valve (4) does not intersect with the screw land (42) to which the discharge side end surface (4*a*) faces both in the part load operation and in the rated load operation, thereby making it possible to avoid communication between the adjacent compression chambers (23, 23) with the screw land (42) interposed therebetween. As a result, it is possible to prevent a pressure loss of the discharged fluid and a reduction in efficiency in both the part load operation and rated load operation.

According to the present first embodiment, the discharge side end surface (4*a*) of the slide valve (4) is formed to extend in a direction corresponding to the suction side edge of the screw land (42) to which the discharge side end surface (4*a*) faces when the slide valve (4) is moved to a position corresponding to the operation state of a load factor of 50% or more and 75% or less. Thus, it is possible to reliably prevent a pressure loss of the discharged fluid and a reduction in efficiency, especially in the operation state of a load factor of 50% or more and 75% or less whose cumulative occurrence frequency per year is high. As a result, the annual performance factor can be improved and annual power consumption can be significantly reduced.

<<The Second Embodiment of Invention>>

In the second embodiment, the shape of the discharge side end surface (4*a*) of the slide valve (4) in the screw compressor (I) according to the first embodiment is changed.

Figure 8:
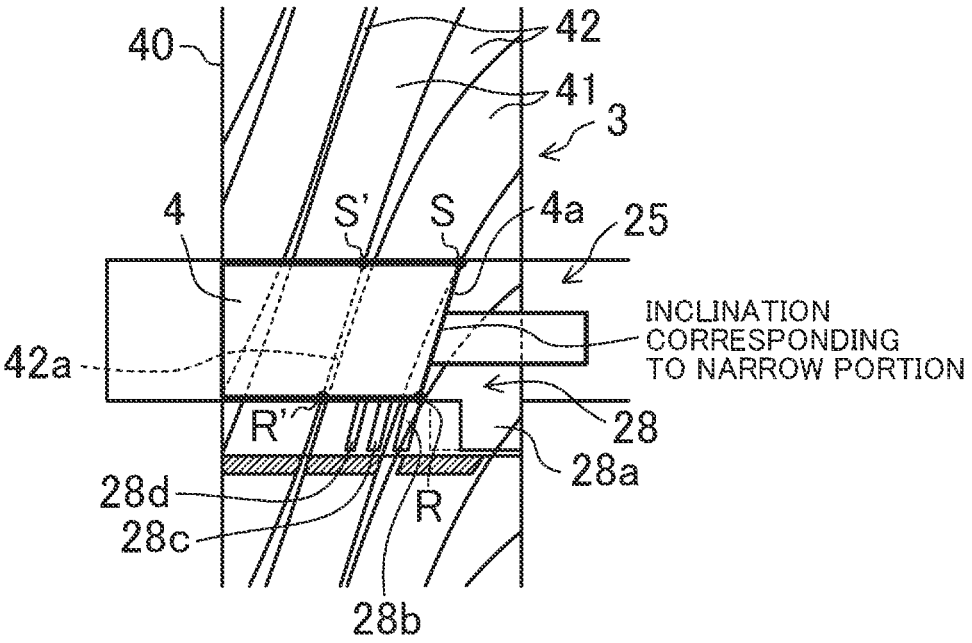
FIG. 8 is a developed view showing a relationship between a slide valve and a screw rotor according to the second embodiment.
Figure 9:
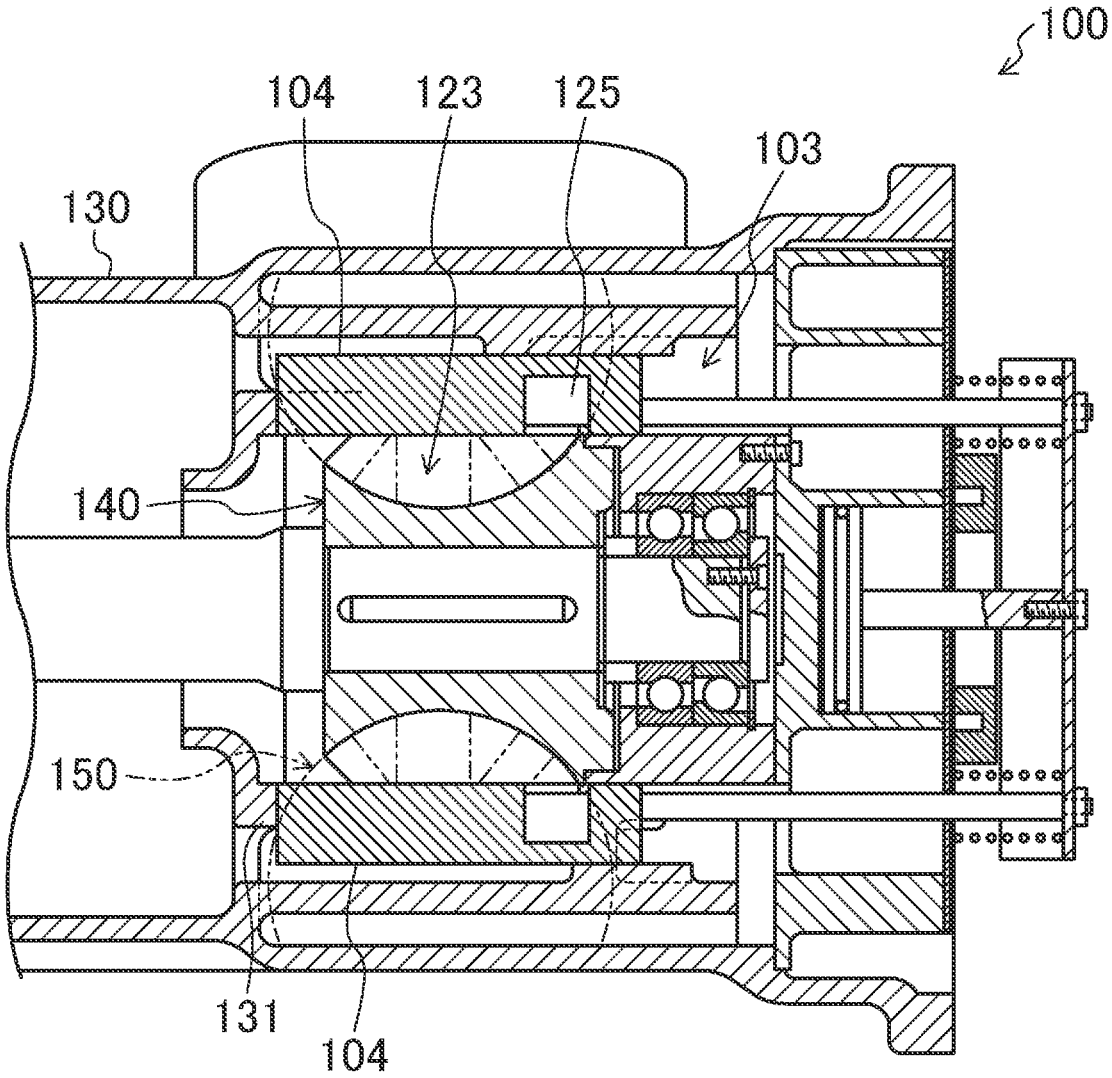
FIG. 9 is a vertical cross-section of a conventional screw compressor.
Figure 10:
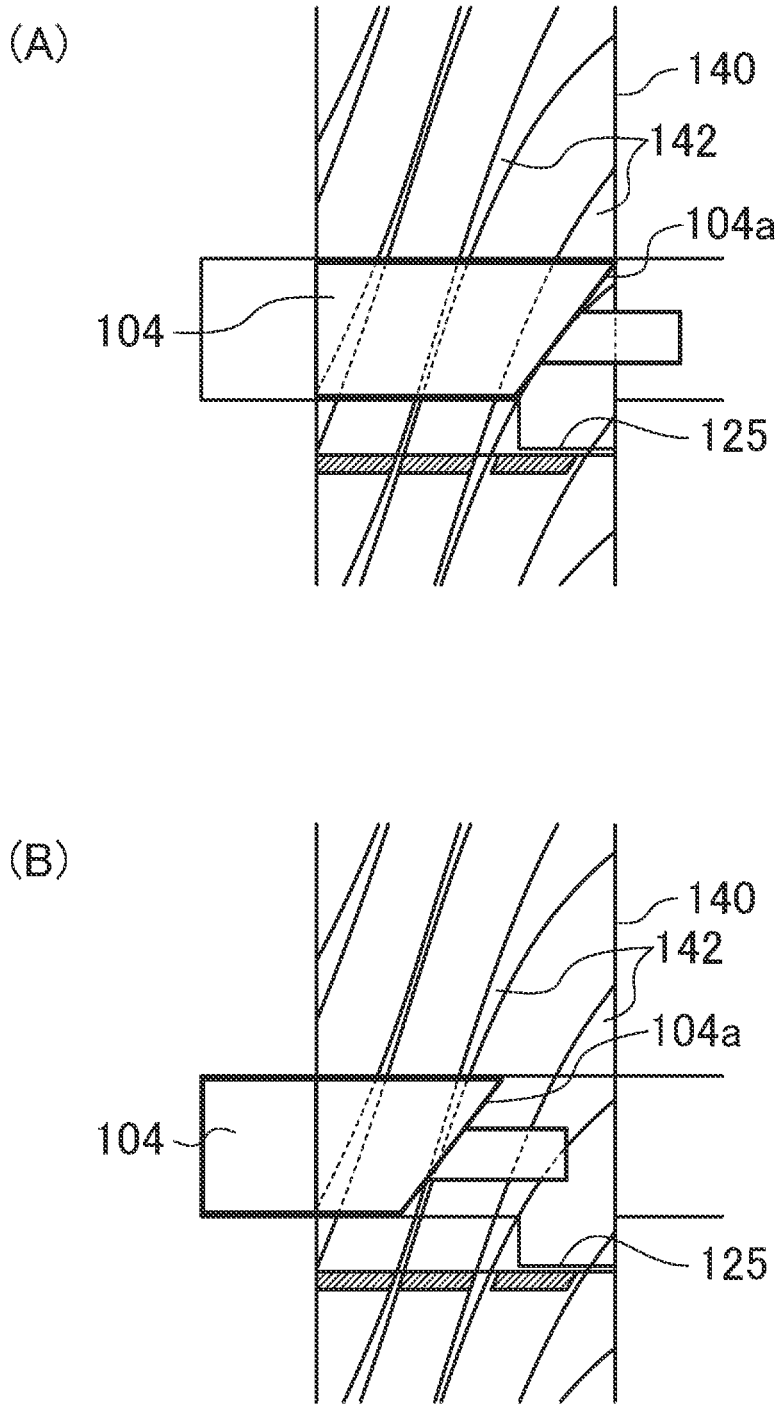
FIG. 10 shows developed views for illustrating the working state of a slide valve of the conventional screw compressor.

Specifically, as shown in FIG. 8, the discharge side end surface (4*a*) of the slide valve (4) is formed to have a shape extending in a direction corresponding to a narrow portion (42*a*) of the screw land (42) which has the narrowest width. More specifically, the inclination of the discharge side end surface (4*a*) of the slide valve (4) is decided based on the inclination of the narrow portion (42*a*) of the screw land (42) (the inclination corresponding to a line segment R'S' between the points and S' which are the projections of two points R and S located at corners of the discharge side end surface (4*a*) shown in FIG. 8, on the suction side edge of the narrow portion (42*a*) of the screw land (42) in the axial direction).

The narrow portion (42*a*) of the screw land (42) whose width and angle are not uniform has a narrower width and a less steep inclination angle that the other portion of the screw land (42). Thus, if the discharge side end surface (4*a*) of the slide valve (4) is formed to extend in a direction corresponding to the narrow portion (42*a*) of the screw land (42), the discharge side end surface (4*a*) of the slide valve (4) does not intersect with the screw land (42) whichever portion of the screw land (42) the discharge side end surface (4*a*) of the slide valve (4) faces.

Thus, according to the second embodiment, the pressure loss of the discharged fluid is prevented, and communication between the adjacent compression chambers (23) with the screw land (42) interposed therebetween is also prevented in the entire range of movement of the slide valve (4), thereby making it possible to prevent a reduction in efficiency. That is, it is possible to achieve the objective of the present invention i.e., to prevent the pressure loss of the discharged fluid and a reduction in efficiency in the part load operation and the rated load operation.

<<Variations of the First and Second Embodiments>>

The first and second embodiments may have the following structures.

In the first embodiment, the discharge side end surface (4*a*) of the slide valve (4) is configured to extend in the direction corresponding to the extending direction of the screw land (42) to which the discharge side end surface (4*a*) faces in the operation state of a load factor of 50% or more and 75% or less. However, the discharge side end surface (4*a*) may be configured to extend in a direction corresponding to an extending direction of the screw land (42) to which the discharge side end surface (4*a*) faces in an operation state of a load factor other than the above load factors. For example, the discharge side end surface (4*a*) of the slide valve (4) may be configured to extend in a direction corresponding to an extending direction of the screw land (42) to which the discharge side end surface (4*a*) faces in the operation state of a load factor of 25%.

In the above case, the pressure loss of the discharged fluid and a reduction in efficiency in the operation state of a load factor of 25% can be prevented with reliability. Further, it is considered that in the annual performance factor, the weight for a load factor of 25% is greater (i.e., the cumulative occurrence frequency per year is higher) than the weight for a load factor of 100%. Thus, even in the above case, it is possible to improve the annual performance factor and reduce the annual power consumption, compared to the case in which the discharge side end surface (4*a*) of the slide valve (4) is configured to extend in the direction corresponding to the extending direction of the screw land (42) to which the discharge side end surface (4*a*) faces in the rated load operation.

Further, in the first and second embodiments, the discharge side end surface (4*a*) of the slide valve (4) is configured to extend in the direction corresponding to the suction side edge of a predetermined portion of the screw land (42). However, the discharge side end surface (4*a*) of the slide valve (4) may be configured to extend in a direction corresponding to a discharge side edge, or may be configured to extend in a direction corresponding to the middle portion between the discharge side edge and the suction side edge.

Further, in the first and second embodiments, the discharge side end surface (4*a*) of the slide valve (4) is formed to have an inclined surface extending in the direction corresponding to a suction side edge of a predetermined portion of the screw land (42), but may be formed to have a curved surface corresponding to a suction side edge of a predetermined portion of the screw land (42). With this structure, it is possible to reliably prevent the pressure loss of the discharged fluid and a reduction in efficiency in an intended operation state.

<<The Third Embodiment of Invention>>

In the third embodiment, the following points regarding the screw compressor (1) of the first embodiment are considered.

Figure 18:
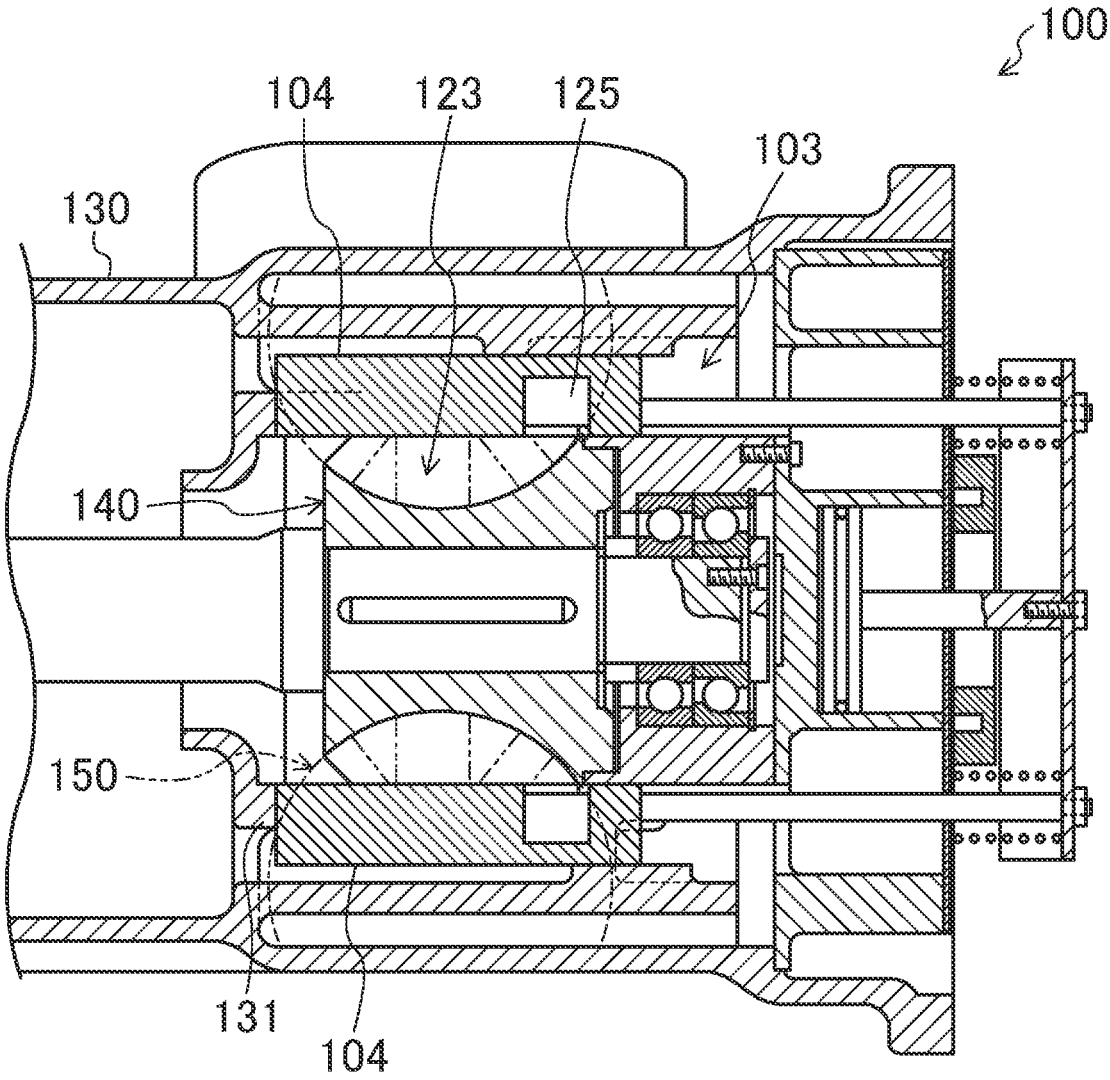
FIG. 18 is a vertical cross-section of a conventional screw compressor.

Single-screw compressors (see FIG. 18) having a compression mechanism which compresses a refrigerant by rotational movement of a screw rotor have been known. In this single-screw compressor (hereinafter referred to as a "screw compressor") (100), a gate rotor (150) meshes with a screw rotor (140) rotating in a cylinder wall (131) of a casing (130), through an opening in the cylinder wall (131), thereby forming a compression chamber (123). One end of the screw rotor (140) (i.e., the left end of the drawing) is a suction side, and the other end (i.e., the right end of the drawing) is a discharge side. When the suction side of the screw rotor (140) is closed out by the gate rotor (150), such a compression chamber (123) is formed in which a low-pressure gas is sealed in a helical groove of the screw rotor (140). From there, the screw rotor (140) is further rotated, making the compression chamber (123) small until the compression chamber (123) moves to the discharge side and communicates with a discharge opening (125), when the high-pressure gas is released to the discharge side of the casing (130).

In the screw compressor (100), it is suggested to provide a slide valve (104) which moves along the axial direction of the screw rotor (140) as a variable VI mechanism (i.e., a volume ratio adjusting mechanism) (103) for adjusting a ratio between the suction volume and the discharge volume (i.e., a volume ratio:VI) (see, for example, Japanese Patent Publication No. 2004-137934). The slide valve (104) is moved along the axial direction of the screw rotor (140) to change the discharge volume by changing the position from which the high-pressure gas starts to be discharged (i.e., completion of compression), thereby changing the ratio of the discharge volume to the suction volume.

The screw compressor (100) is configured to change the rotational speed of an electric motor (not shown) by controlling an inverter, thereby controlling the operating capacity. The operating capacity (i.e., the amount of refrigerant discharged per unit time) is controlled according to a load on the utilization side of the refrigerant circuit. Here, the slide valve (104) of the variable VI mechanism (103) is controlled to obtain a volume ratio (i.e., a compression ratio) which can lead to optimal compression efficiency, with respect to the operating capacity controlled according to the load. Thus, the slide valve (104) moves along the axial direction of the screw rotor (140) according to the operating capacity which varies depending on whether the operation state is a rated load state (100% load) or a part load state. In the screw compressor (100), the position of the slide valve (104) is changed such that the size of the discharge side opening is larger in the part load operation state than in the rated load operation state.

Figure 19:
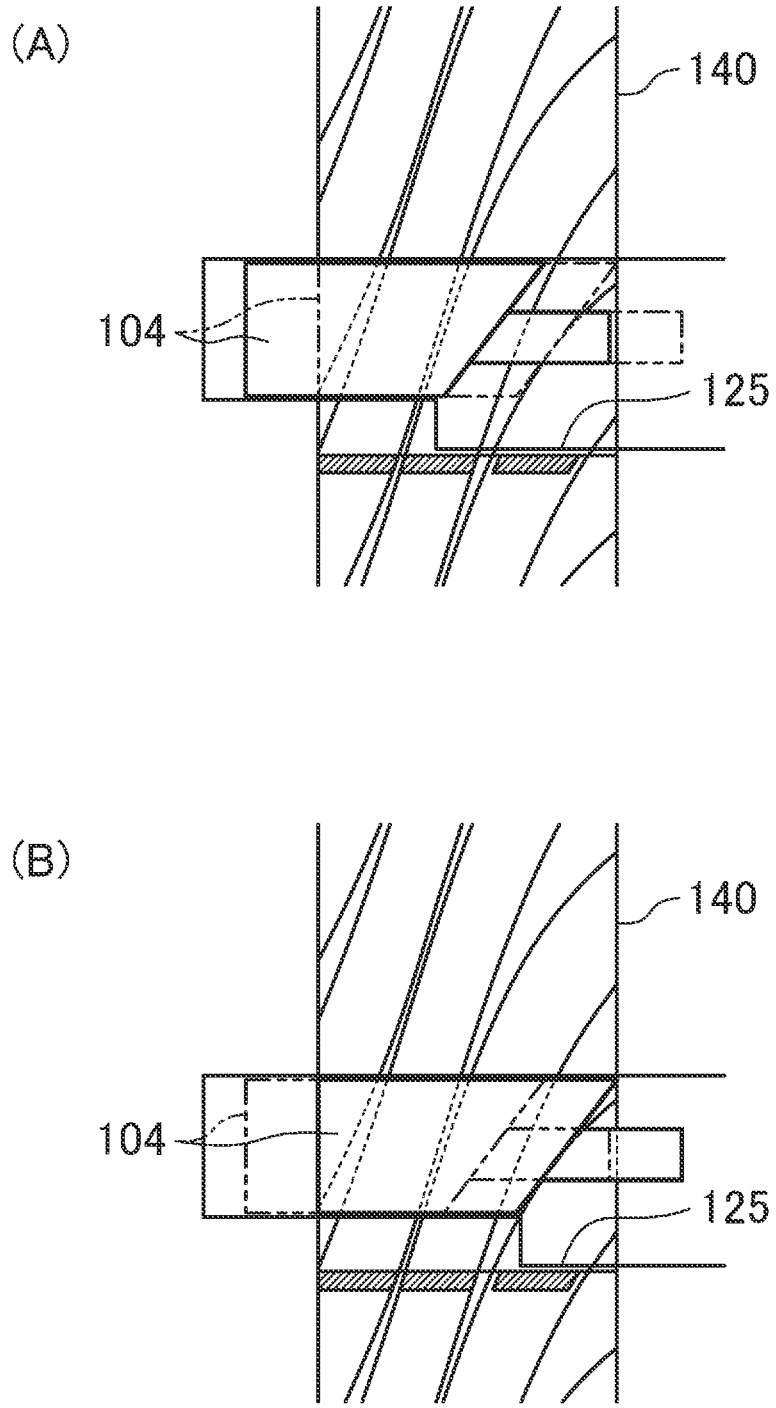
FIG. 19(A) is a developed view showing a shape of a discharge opening of the conventional screw compressor.
FIG. 19(B) is a developed view showing a variation of the shape of the discharge opening of the conventional screw compressor.

If the discharge opening (125) formed in the casing (130) is formed to have a maximum opening area in the part load operation state as shown in FIG. 19(A), the discharge opening intersects with the land of the screw rotor (140), and adjacent helical grooves communicate with each other. This means that the adjacent compression chambers in which the pressures are different may communicate with each other in the rated load operation state, and as a result, an intended compression ratio cannot be obtained. For this reason, the opening area of the discharge opening needs to be determined to correspond to the rated load operation state, as shown in FIG. 19(B).

However, if the opening area of the discharge opening (125) in the casing (130) is determined to correspond to the rated load operation state, the opening area is not sufficient when the slide valve (104) is moved to a position corresponding to the part load state indicated by the phantom line in FIG. 19(B). As a result, the pressure loss due to a discharge resistance may be increased in the part load operation, which results in a reduction in performance of the screw compressor.

The invention described in the third embodiment was made in view of the above problem, and it is an objective of the invention to prevent a problem due to communication between the compression chambers having different pressures, in the rated load operation state, and prevent a reduction in performance of the screw compressor in the part load operation state by ensuring a sufficiently large discharge opening area.

The first example of the third embodiment is intended for a single-screw compressor which includes: a screw rotor (40) having, in its outer circumferential surface, a helical groove (41) whose one end serves as a suction side and the other end serves as a discharge side of a fluid; a casing (30) having a cylinder wall (31) in which the screw rotor (40) is rotatably accommodated; a driving mechanism (26) which drives the screw rotor (40) at a variable rotational speed according to a load; a volume ratio adjusting mechanism (3) including a slide valve (4) which is provided in a slide groove (33) formed in the cylinder wall (31) in an axial direction of the cylinder wall (31), the slide valve (4) being movable in the axial direction to adjust a discharge start position; and a discharge opening (28) formed in the casing (30) to communicate, at a discharge side of the screw rotor (40), with a compression chamber (23) formed in the helical groove (41) of the screw rotor (40).

The discharge opening (28) of this single-screw compressor includes a main discharge port (28*a*) and auxiliary discharge ports (28*b*, 28*c*, 28*d*). The shape of the opening of the main discharge port (28*a*) is determined according to the position of the slide valve (1) in the rated load operation state, and the main discharge port (28*a*) is open in both of the rated load operation state and the part load operation state, without being closed by the slide valve (4), and allows a fluid to be discharged. The shapes of the openings of the auxiliary discharge ports (28*b*, 28*c*, 28*d*) are determined according to the position of the slide valve (4) in the part, load operation state. The auxiliary discharge ports (28*b*, 28*c*, 28*d*) are closed by the slide valve (4) in the rated load operation state, and are opened from the slide valve (4) in the part load operation state to allo a fluid to be discharged.

In the first example of the third embodiment, when the screw compressor is in the rated load operation state, the auxiliary discharge ports (28*b*, 28*c*, 28*d*) are closed by the slide valve (4). Thus, a fluid such as a refrigerant is discharged only from the main discharge port (28*a*). The main discharge port (28*a*) is formed to correspond to the position of the slide valve (4) in the rated load operation state, and therefore, the adjacent compression chambers (23) do not communicate with each other. Further, when the screw compressor is in a part load operation state, the slide valve (4) is moved to a position corresponding to the operating capacity. Since the auxiliary discharge ports (28*b*, 28*c*, 28*d*) are open without being closed by the slide valve (4), a fluid is discharged from both of the main discharge port (28*a*) and the auxiliary discharge ports (28*b*, 28*c*, 28*d*), thereby reducing a discharge resistance.

According to the second example of the third embodiment, the single-screw compressor of the first example of the third embodiment includes a plurality of auxiliary discharge ports (28*b*, 28*c*, 28*d*) corresponding to a plurality of part load operation states.

In the second example of the third embodiment, since the plurality of auxiliary discharge ports (28*b*, 28*c*, 28*d*) are provided, the single-screw compressor is controlled in accordance with the plurality of part load operation states, using the plurality of auxiliary discharge ports (28*b*, 28*c*, 28*d*).

According to the third example of the third embodiment, in the second example of the third embodiment, the auxiliary discharge ports (28*b*, 28*c*) are the two ports which correspond to a 75% load operation state and a 50% load operation state, respectively. The auxiliary discharge port (28*b*) corresponding to the 75% load operation state is located at a position where the auxiliary discharge port (28*b*) is closed by the slide valve (4) in the rated load operation state, and open in the 75% load operation state and the 50% load operation state. The auxiliary discharge port (28*c*) corresponding to the 50% load operation state is located at a position where the auxiliary discharge port (28*c*) is closed by the slide valve (4) in the rated load operation state and the 75% load operation state, and open in the 50% load operation state.

According to the fourth example of the third embodiment, in the second example of the third embodiment, the auxiliary discharge ports (28*b*, 28*c*, 28*d*) are the three ports which correspond to a 75% load operation state, a 50% load operation state, and a 25% load operation state, respectively. The auxiliary discharge port (28*b*) corresponding to the 75% load operation state is located at a position where the auxiliary discharge port (28*b*) is closed by the slide valve (4) in the rated load operation state, and open in the 75% load operation state, the 50% load operation state, and the 25% load operation state. The auxiliary discharge port (28*c*) corresponding to the 50% load operation state is located at a position where the auxiliary discharge port (28*c*) is closed by the slide valve (4) in the rated load operation state and the 75% load operation state, and open in the 50% load operation state and the 25% load operation state. The auxiliary discharge port (28*d*) corresponding to the 25% load operation state is closed by the slide valve (4) in the rated load operation state, the 75% load operation state, and the 50% load operation state, and open in the 25% load operation state.

Here, an annual performance factor is known as a coefficient of performance (COP) of a refrigeration apparatus. The annual performance factor is an annual COP obtained by weighting COPs in various load operations because there are heavy load operation periods, light load operation periods, middle load operation periods, etc., within a year. The annual performance factor includes, for example, an integrated part load value (IPLV) defined by Air-Conditioning and Refrigeration Institute. The IPLV is defined by the following formula $$\mathrm{IPLV}=0.01A+0.42B+0.45C+0.12D$$

where A is a COP at a rated (100%) load; B is a COP at a load factor of 75%; C is a COP at a load factor of 50%; and D is a COP at a load factor of 25%. This means that if the IPLVs of all the targeted chillers are averaged, 45% of annual operation time is an operation at a load factor of 50%; 42% of annual operation time is an operation at a load factor of 75%; 12% of annual operation time is an operation at a load factor of 25%; and 1% of annual operation time is an operation at a load factor of 100%.

The weighting values may be slightly different between the US and Japan, but it is still important place importance on COPs in part load operations. Thus, it is preferable to increase operational efficiency in the part load operation. According to the third example of the third embodiment, the auxiliary discharge ports (28*b*, 28*c*) used in the part load operation are formed based on the two operation states, i.e., a 75% load operation state and a 50% load operation state. In the fourth example of the third embodiment, the auxiliary discharge ports (28*b*, 28*c*, 28*d*) used in the part load operation are formed based on the three operation states, i.e., a 75% load operation state, a 50% load operation state, and a 25% load operation state. In this structure, the area of the discharge opening (28) is large when the slide valve (4) is moved to the position corresponding to the part load operation state. As a result, it is possible to reduce a discharge resistance in the part load operation which plays an important role in increasing the annual performance factor.

According to the fifth example of the third embodiment, in any one the second to fourth examples of the third embodiment, the discharge side end surface (4*a*) of the slide valve (4) is inclined in a direction corresponding to the inclination of the helical groove (41) on the discharge side of the slide valve (4) in the part load operation state, and the side surfaces of the auxiliary discharge ports (28*b*, 28*c*, 28*d*) are tilted to align with the inclination of the discharge side end surface (4*a*) of the slide valve (4).

Figure 16:
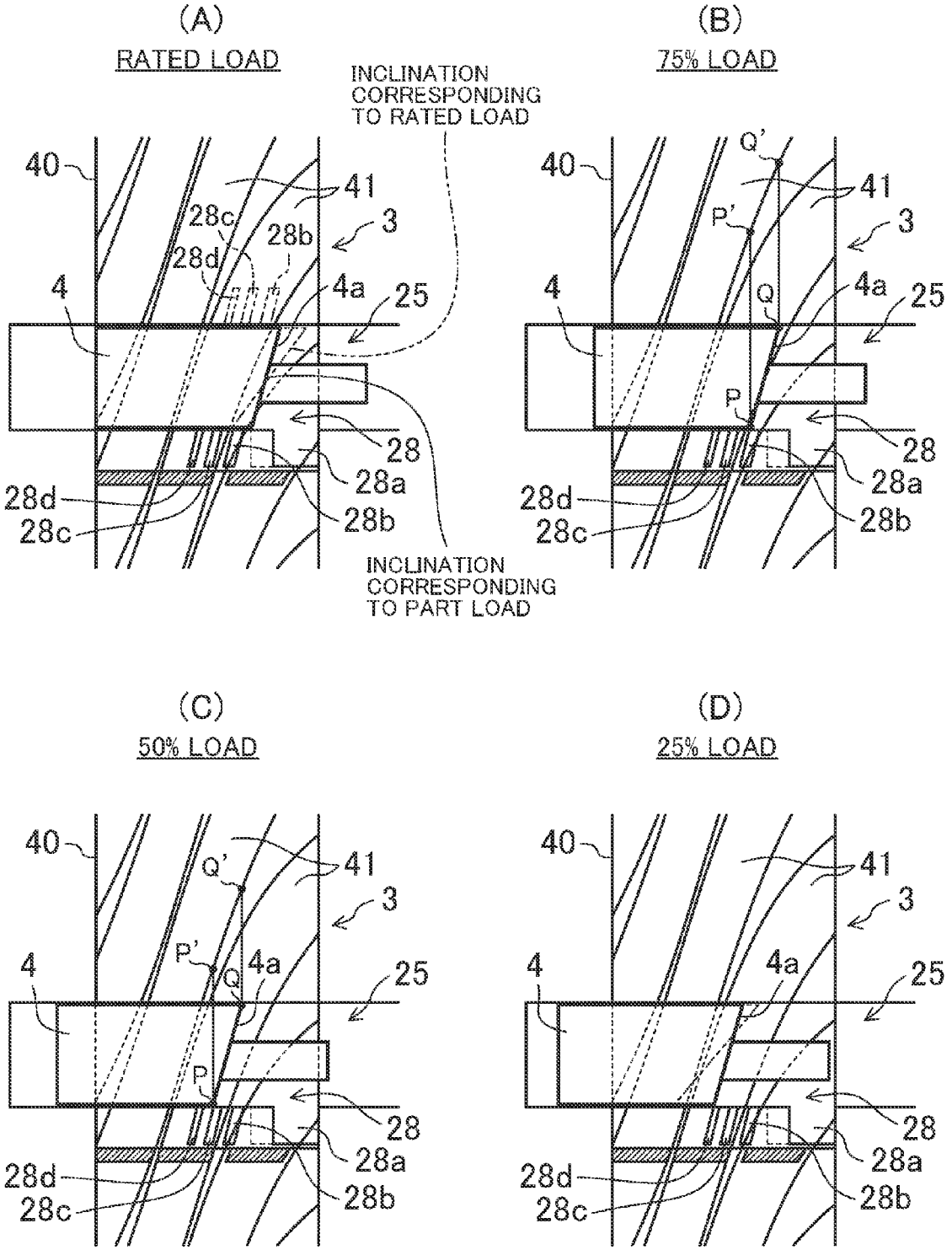
FIG. 16 shows developed views illustrating the working state of the slide valve.

In the fifth example of the third embodiment, because the inclination of the helical groove (41) corresponding to the position of the slide valve (4) in the part load operation is less steep than the inclination of the helical groove (41) corresponding to the position of the slide valve (4) in the rated load operation (see FIG. 16), the discharge side end surface (4*a*) of the slide valve (4) has a gentle inclination, and each of the side surfaces of the auxiliary discharge ports (28*b*, 28*c*, 28*d*) has a gentle inclination, as well. If this inclination is steep, the adjacent compression chambers (23) may communicate with each other. However, the inclination is gentle in the fifth example of the third embodiment, and thus, communication between the adjacent compression chambers (23) can be reliably prevented.

According to the sixth example of the third embodiment, in the fifth example of the third embodiment, the width of each of the auxiliary discharge ports (28*b*, 28*c*, 28*d*) is narrower than a land width (that is, a width of a raised portion between adjacent helical grooves (41)) of the screw which is inclined to correspond to the inclination of the discharge side end surface (4*a*) of the slide valve (4).

In the sixth example of the third embodiment, the widths of the auxiliary discharge ports (28*b*, 28*c*, 28*d*) are narrower than the width of the land width of the screw. Thus, the auxiliary discharge ports (28*b*, 28*c*, 28*d*) do not intersect with the land, and adjacent compression chambers (23) (i.e., the helical grooves (41)) do not communicate with each other.

According to the seventh example of the third embodiment, in the fifth or sixth example of the third embodiment, the widths of the plurality of auxiliary discharge ports (28*b*, 28*c*, 28*d*) are reduced sequentially from the discharge side to the suction side.

In the seventh example of the third embodiment, the width of each of the auxiliary discharge ports (28*b*, 28*c*, 28*d*) is reduced from the discharge side to the suction side according to the land width corresponding to the discharge side of the slide valve (4), the land width being reduced from the discharge side to the suction side (see FIG. 16) in the range of movement of the slide valve (4). Thus, in the seventh example of the third embodiment, too the auxiliary discharge ports (28*b*, 28*c*, 28*d*) do not intersect with the land, and adjacent compression chambers 23) (i.e., the helical grooves (41)) do not communicate with each other.

According to the first example of the third embodiment, a fluid is discharged only from the main discharge port (28*a*) when the screw compressor is in the rated load operation state, and the compression chambers (23) located next to each other at this time do not communicate with each other. Therefore, it is possible to prevent problems caused by communication between the compression chambers (23) having different pressures. Further, when the screw compressor is in the part load operation state, the fluid is discharged from both of the main discharge port (28*a*) and the auxiliary discharge ports (28*b*, 28*e*, 28*d*). Therefore, it is possible to obtain a sufficiently large discharge opening area. This means that the pressure loss due to a discharge resistance does not increase, and as a result, it is possible to prevent a reduction in performance of the screw compressor.

According to the second example of the third embodiment, the provision of the plurality of auxiliary discharge ports (28*b*, 28*c*, 28*d*) enables detailed control according to the plurality of part load operation states. Thus, it is possible to prevent a reduction in performance of the screw compressor more reliably.

According to the third example of the third embodiment, the auxiliary discharge ports (28*b*, 28*c*) used in the part load operation are formed based on two operation states, i.e., the 75% load operation state and the 50% load operation state. According to the fourth example of the third embodiment, the auxiliary discharge ports (28*b*, 28*c*, 28*d*) used in the part load operation are formed based on three operation states, i.e., the 75% load operation state, the 50% load operation state, and the 25% load operation state. Thus, the area of the discharge opening (28) can be increased in these part load operation states. Accordingly, it is possible to reduce a discharge resistance, and therefore, possible to reduce a pressure loss in the part load operation states, which results in increasing the annual performance factor.

According to the fifth example of the third embodiment, the inclination of the discharge side end surface (4*a*) of the slide valve (4) and the inclination of the side surfaces of the auxiliary discharge ports (28*b*, 28*c*, 28*d*) are gentle. Thus, it is possible to prevent the adjacent compression chambers (23) from communicating with each other through the auxiliary discharge ports (28*b*, 28*c*, 28*d*) in the rated load operation, etc., with reliability. Accordingly, it is possible to reliably prevent a problem in which an intended compression ratio cannot be obtained.

According to the sixth example of the third embodiment, the widths of the auxiliary discharge ports (28*b*, 28*c*, 28*d*) are narrower than the width of the land width of the screw to prevent the adjacent compression chambers (23) (i.e., the helical grooves (41)) from communicating with each other through the auxiliary discharge ports (28*b*, 28*c*, 28*d*). Thus, the adjacent compression chambers (23) do not communicate with each other in the rated load operation, etc. and the advantages in the fifth example of the third embodiment can be more reliably obtained.

According to the seventh example of the third embodiment, the widths of the auxiliary discharge ports (28*b*, 28*c*, 28*d*) are reduced sequentially from the discharge side to the suction side, in accordance with the width of the land which corresponds to the discharge side of the slide valve (4), the width of the land being reduced from the discharge side to the suction side. Thus, the adjacent compression chambers (23) do not communicate with each other in the rated load operation, etc. and the advantages in the fifth and sixth examples of the third embodiment can be more reliably obtained.

The third embodiment will be described in detail below, based on the drawings.

A single-screw compressor (1) (hereinafter simply referred to as a "screw compressor") of the present third embodiment is provided in a refrigerant circuit which performs a refrigeration cycle to compress a refrigerant.

The screw compressor (1) includes a compression mechanism (20) and a variable VI mechanism (i.e., a volume ratio adjusting mechanism) (3) for adjusting a ratio between the suction volume and the discharge volume (i.e., a volume ratio:VI) of the compression mechanism (20).

<Compression Mechanism>

Figure 11:
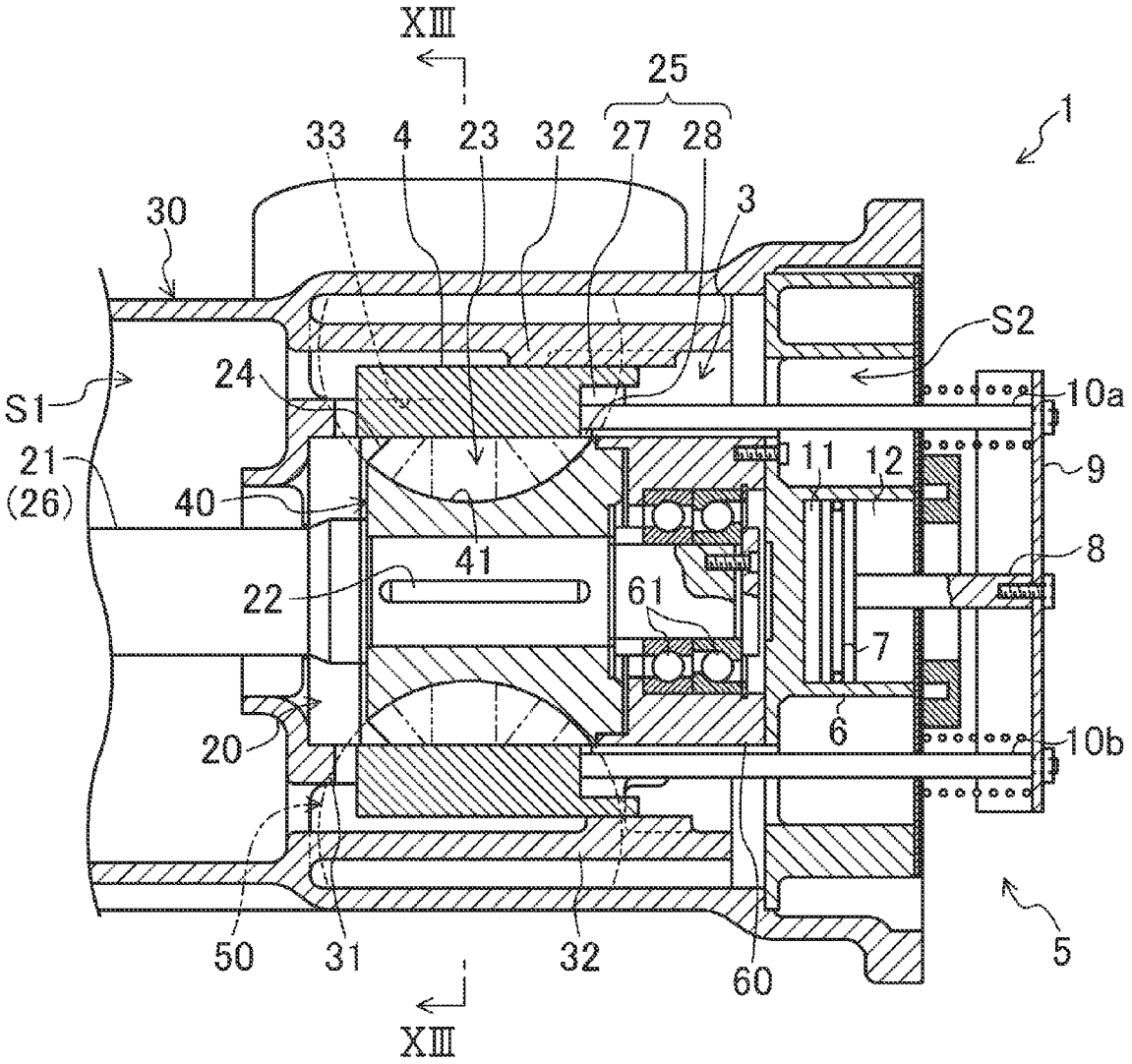
FIG. 11 is a vertical cross-section showing a structure of a main part of a screw compressor according to the third embodiment of the present invention, in a high VI operation state corresponding to a rated load.
Figure 12:
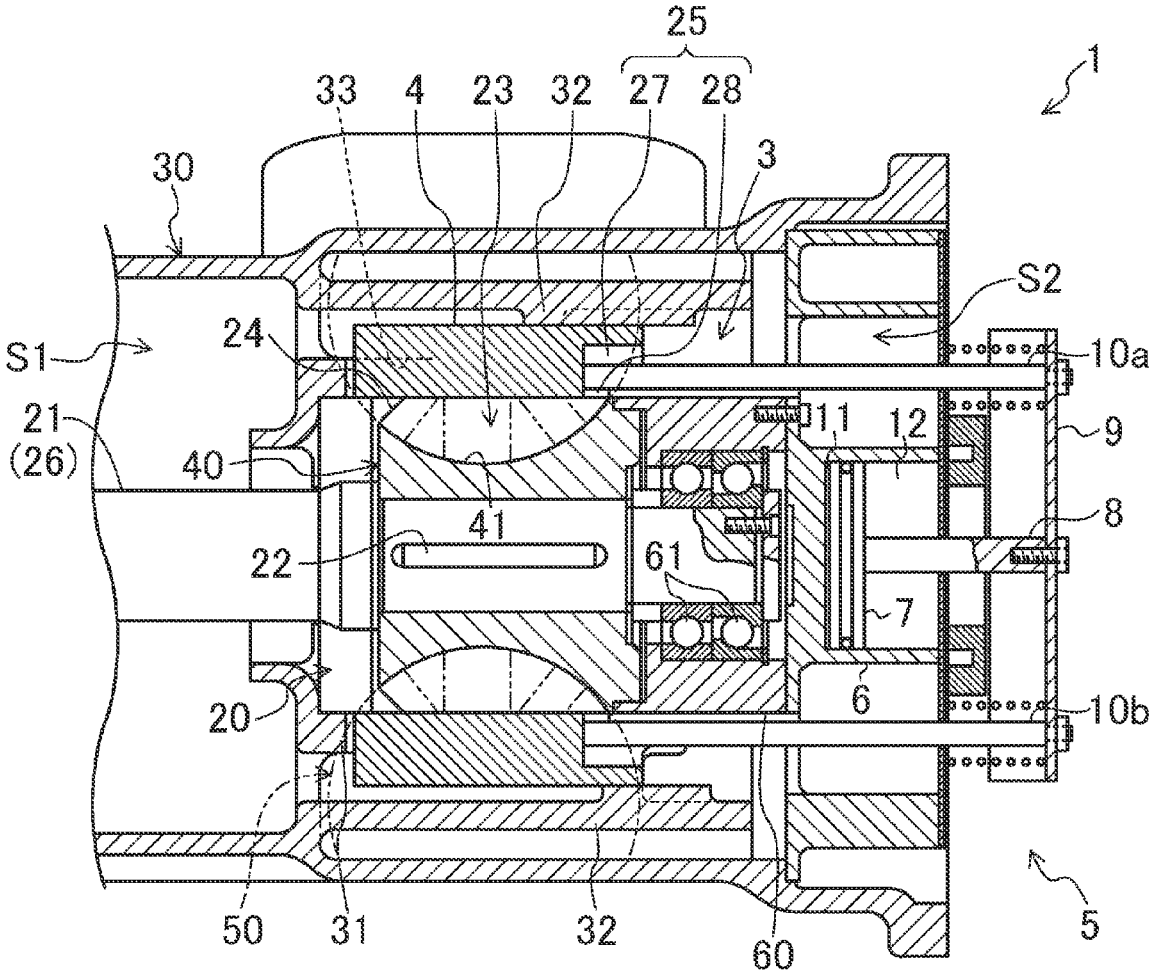
FIG. 12 is a vertical cross-section showing the structure of the main part of the screw compressor in FIG. 11, in a low VI operation state corresponding to a part load.
Figure 13:
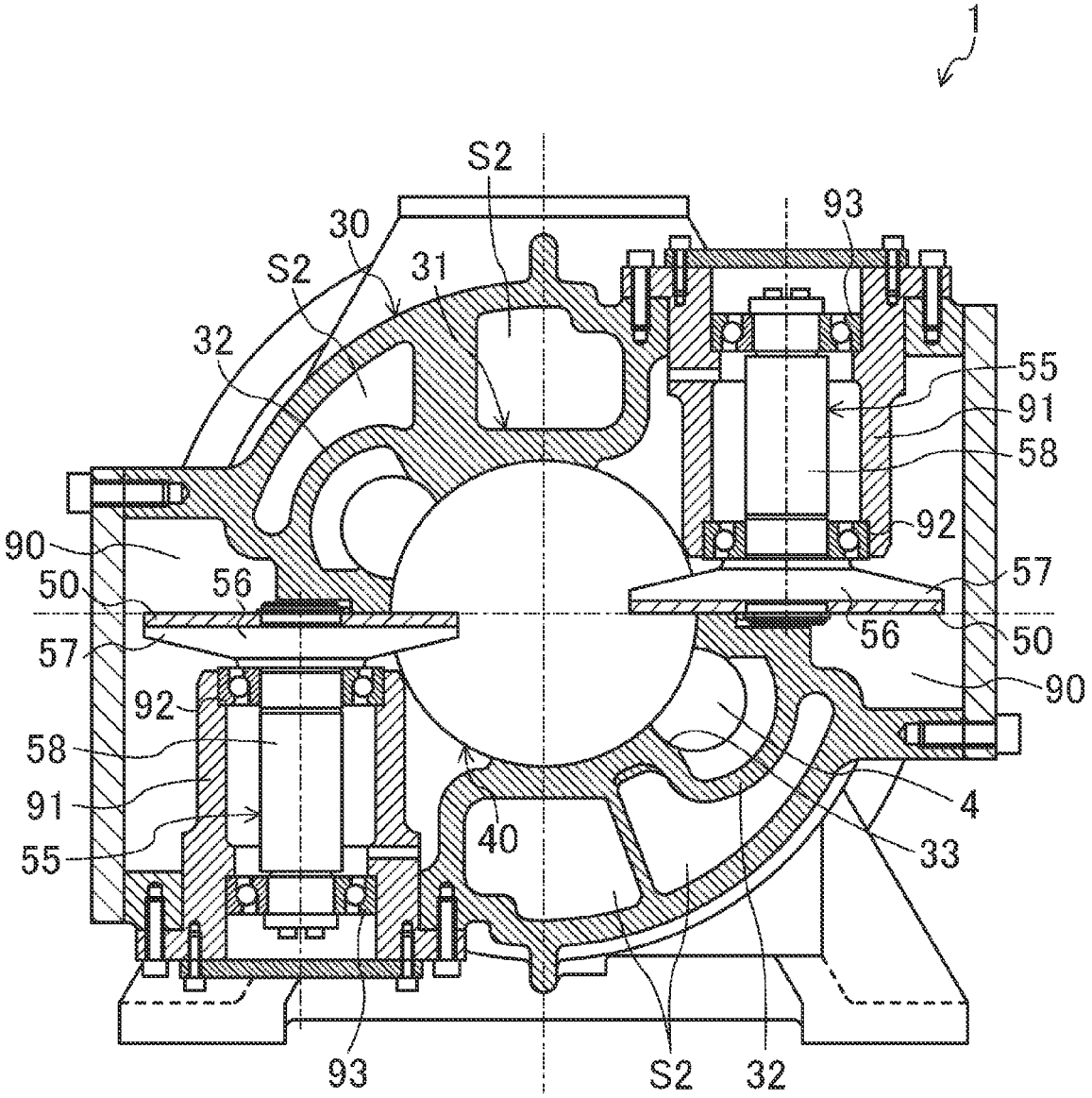
FIG. 13 is a lateral cross-section taken along the line XIII-XIII of FIG. 11.

The compression mechanism (20) includes a cylinder wall (31) formed in a casing (30) of the screw compressor (1), one screw rotor (40) rotatably provided in the cylinder wall (31), and two gate rotors (50) which mesh with the screw rotor (40) as shown in FIGS. 11-13.

A suction space (S1) facing a suction opening (24) of the compression mechanism (20), and a discharge space (S2) facing a discharge opening (25) of the compression mechanism (20) are formed in the casing (30). The cylinder wall (31) is provided with two communicating portions (32) along a circumferential direction of the cylinder wall (31), which protrude outward from the circumferential direction of the cylinder wall (31) for communicating the suction space (S1) and the discharge space (S2). Each of the communicating portions (32) includes a slide groove (33) which extends along the axial direction of the cylinder wall (31). A slide valve (4), described later, is fitted in the slide groove (33) to be movable in the axial direction. The slide groove (33) and the slide valve (4) form the variable VI mechanism (3). The discharge opening (25) includes a valve-side discharge opening (277) formed at the slide valve (4), and a cylinder-side discharge opening (28) formed at the cylinder wall (31).

A drive shaft (21) which extends from an electric motor (not shown) is inserted in the screw rotor (40). The screw rotor (40) and the drive shaft (21) are coupled with a key (22), so that the screw rotor (40) is driven by a driving mechanism (26) which includes the electric motor and the drive shaft (21). The drive shaft (21) is arranged coaxially with the screw rotor (40). A tip end of the drive shaft (21) is rotatably supported by a bearing holder (60) provided on a discharge side of the compression mechanism (20) (on the right side of the compression mechanism, provided that the axial direction of the drive shaft (21) in FIG. 11 is a right-left direction). The bearing holder (60) supports the drive shaft (21) through ball bearings (61). The screw rotor (40) is rotatably fitted to the cylinder wall (31), and the outer circumferential surface of the screw rotor (40) slides on the inner circumferential surface of the cylinder wall (31) with an oil film interposed therebetween.

The rotational speed of the electric motor can be adjusted by controlling an inverter. Thus, the operating capacity of the screw compressor (1) can be changed by adjusting the rotational speed of the electric motor. The operating capacity of the screw compressor (1) (i.e., the amount of refrigerant discharged per unit time) is controlled according to a load on the utilization side of the refrigerant circuit. The slide valve (4) of the variable VI mechanism (3) is controlled to obtain a volume ratio (i.e., the compression ratio) which can lead to optimal compression efficiency, with respect to the operating capacity controlled according to the load. Specifically, the slide valve (4) moves in the axial direction of the screw rotor (40) according to the operating capacity which varies depending on whether the operation state is a rated load (100% load) state or a part load state. In the screw compressor (1), if the rated load operation state (the state shown in FIG. 11) and the part load operation state (the state as shown in FIG. 12) are compared, the position of the slide valve (4) is more to the left of FIG. 11 (i.e., to the suction side) in the operation state of a lighter load, to increase the area of the cylinder-side discharge opening (28).

Figure 14:
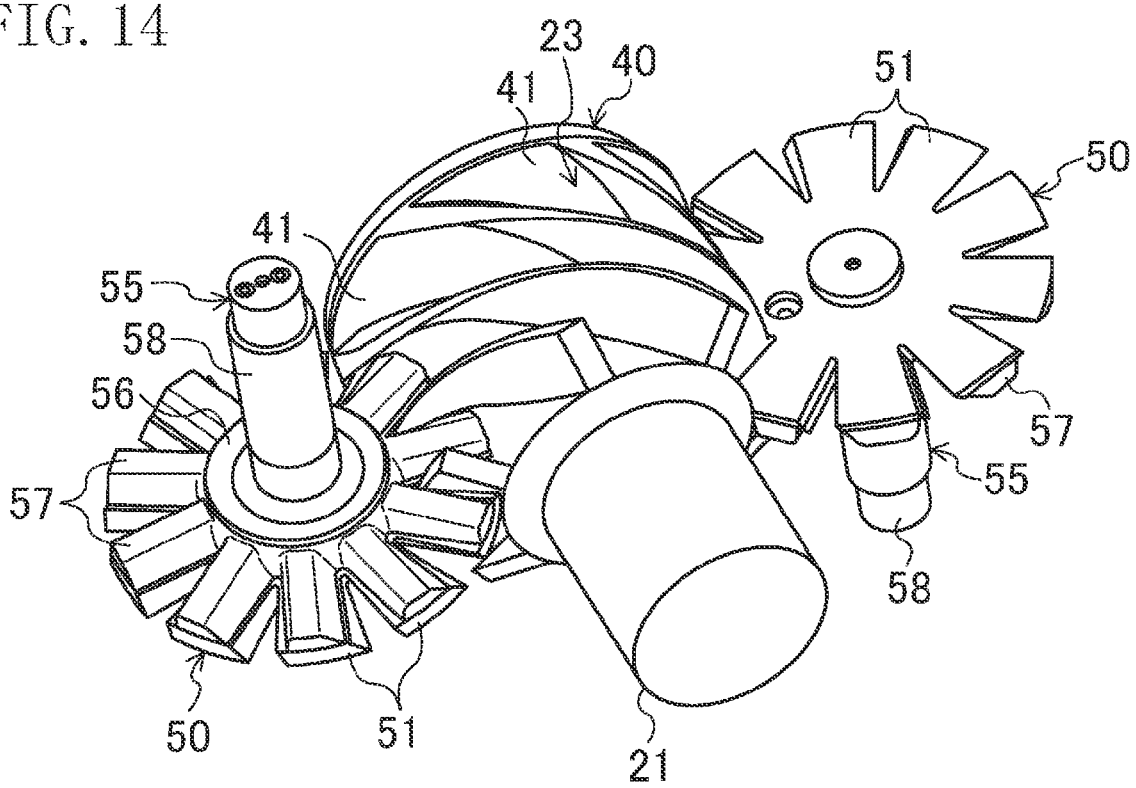
FIG. 14 is an oblique view focusing on the main part of the screw compressor.
Figure 15:
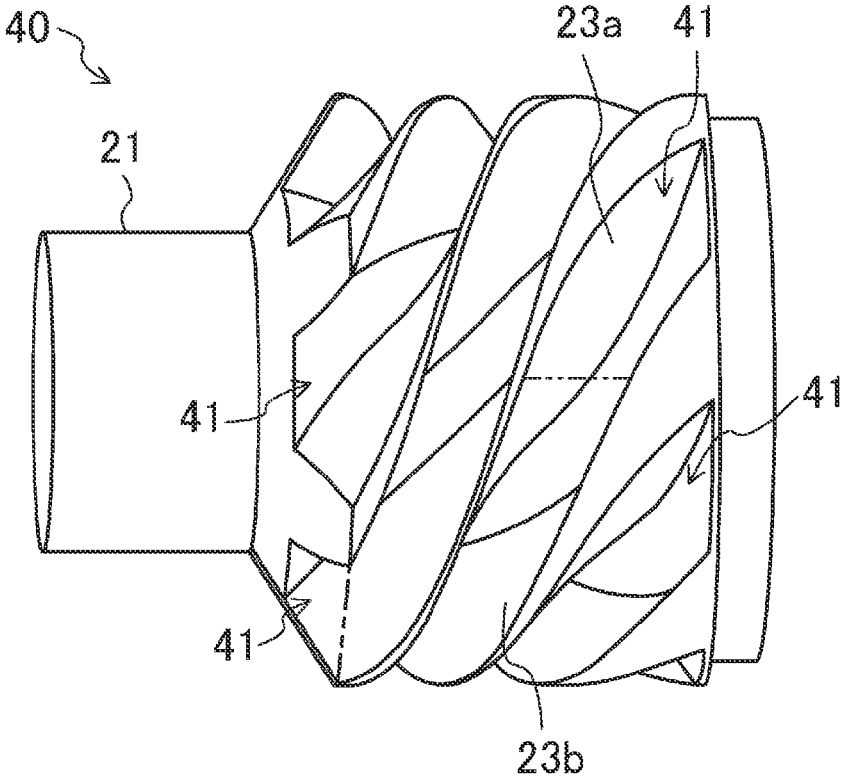
FIG. 15 is an oblique view showing the screw rotor of the screw compressor.

The screw rotor (40) shown in FIG. 14 and FIG. 15 is a metal member having a substantially columnar shape. The screw rotor (40) includes, in its outer circumferential surface, a plurality of helical grooves (41) (six helical grooves in the third embodiment) which extend helically from one end (the end portion on the fluid (refrigerant) suction side) to the other end (the end portion on the discharge side) of the screw rotor (40).

In each of the helical grooves (41) of the screw rotor (40), the left end in FIG. 15 (the end portion of the suction side) is a start end, and the right end in FIG. 15 is a terminal end (the side from which a fluid is discharged). The left end portion of the screw rotor (40) is tapered as shown in FIG. 15. In the screw rotor (40) shown in FIG. 15, the start ends of the helical grooves (41) are open in the tapered left end surface, but the terminal ends of the helical grooves (41) are not open in the right end surface of the screw rotor (40).

Each of the gate rotors (50) is a member made of resin. The gate rotor (50) has a plurality of radially arranged, rectangular plate-shaped gates (51) (11 gates in the third embodiment). The gate rotors (50) are arranged outside the cylinder wall (31) to be axially symmetric with the axis of rotation of the screw rotor (40). That is, in the screw compressor (1) of the present third embodiment, the two gate rotors (50) are arranged at equal angular intervals about the axis of rotation of the screw rotor (40) (at 180° intervals in the present third embodiment). A shaft center of each gate rotor (50) is perpendicular to a shaft center of the screw rotor (40). Each gate rotor (50) is arranged such that the gates (51) penetrate part (not shown) of the cylinder wall (31) to mesh with the helical grooves (41) of the screw rotor (40).

The gate rotors (50) are attached to metal rotor supports (55), respectively (see FIG. 14). Each of the rotor supports (55) includes a base (56), arms (57), and a shaft (58). The base (56) is in the shape of a slightly thick disc. The number of the arms (57) is the same as the number of the gates (51) of the gate rotor (50), and the arms (57) extend radially outward from an outer circumferential surface of the base (56). The shaft (58) is in the shape of a rod, and is placed to stand on the base (56). A center axis of the shaft (58) coincides with a center axis of the base (56). The gate rotor (50) is attached to the base (56) and the arms (57) on the side opposite to the shaft (58). The arms (57) are in contact with rear surfaces of the gates (51), respectively.

Each of the rotor supports (55) to which the gate rotor (50) is attached is placed in a gate rotor chamber (90) provided adjacent to the cylinder wall (31) in the casing (30) (see FIG. 13). The rotor support (55) on the right of the screw rotor (40) in FIG. 13 is arranged, with the gate rotor (50) facing downward. The rotor support (55) on the left of the screw rotor (40) in FIG. 13 is arranged, with the gate rotor (50) facing upward. The shaft (58) of each of the rotor supports (55) is rotatably supported by a bearing housing (91) in the gate rotor chamber (90) through ball bearings (92, 93). Each of the gate rotor chambers (90) communicates with the suction space (S1).

In the compression mechanism (20), the space surrounded by the inner circumferential surface of the cylinder wall (31), the helical grooves (41) of the screw rotor (40), and the gates (51) of the gate rotors (50) forms the compression chamber (23). The compression chamber (23) includes a first compression chamber (23*a*) located above the horizontal central line in FIG. 13, and a second compression chamber (23*b*) below the central line (see FIG. 15). The suction side edges of the helical grooves (41) of the screw rotor (40) are open to the suction space (S1), and this open area is the suction opening (24) of the compression mechanism (20).

<Variable VI Mechanism (Volume Ratio Adjusting Mechanism)>

The variable VI mechanism (3) includes a hydraulic cylinder (5) which is fixed to the discharge side of the bearing holder (60) and located in the discharge space (S2), in addition to the slide groove (33) of the communicating portion (32) provided on the cylinder wall (31), and the slide valve (4) slidably fitted in the slide groove (33) (see FIGS. 11 and 12).

The slide valve (4) is provided in each of the first and second compression chambers 23*a*, 23*b*). As described above, the slide valve (4) and the cylinder wall (31) are provided with the valve-side discharge opening (27) and the cylinder-side discharge opening (28), respectively, which form the discharge opening (25) of the compression mechanism (20). The compression chamber (23) and the discharge space (S2) communicate with each other through the discharge opening (25). The inner surface of the slide valve (4) forms part of the inner circumferential surface of the cylinder wall (31), and the slide valve (4) is configured to be slidable in the direction of the shaft center of the cylinder wall (31). One end of the slide valve (4) faces the discharge space (S2), and the other end of the slide valve (4) faces the suction space (S1).

The hydraulic cylinder (5) includes a cylinder tube (6), a piston (7) inserted in the cylinder tube (6), an arm (9) coupled to a piston rod (8) of the piston (7), a coupling rod (10*a*) which couples the arm (9) and the slide valve (4), and a spring (lob) which biases the arm (9) to the right in FIG. 11 (to the direction in which the arm (9) is separated from the casing (30)). On both sides of the piston (7) in the cylinder tube (6), a first cylinder space (11) (on the left side of the piston (7) in FIG. 11) and a second cylinder space (12) (on the right side of the piston (7) in FIG. 11) are formed. The hydraulic cylinder (5) is configured to adjust the position of the slide valve (4) by adjusting the pressures of the cylinder spaces (11, 12) on the right and left sides of the piston (7).

When the slide valve (4) slides, the size of the discharge opening (25) is changed, and a terminal position of a compression phase (or a start position of a discharge phase) is changed. For example, FIG. 11 shows the state in which the slide valve (4) slides to the right. In this state, the discharge opening (25) is open substantially at the terminal end of the helical grooves (41). This state corresponds to the rated load operation state (a high VI operation state). When the screw compressor (1) is in this state, discharge is performed at the latest timing, and the compression ratio is largest.

FIG. 12 shows the state in which the slide valve (4) slides to the left. In this state, the discharge opening (25) is open at a location near the middle of the helical groove (41). This state corresponds to the part load operation state (a low VI operation state). In this state, discharge is performed earlier than the discharge performed in the high VI operation state (see FIG. 11), and the compression ratio is smaller than the compression ratio in the high VI operation state.

In the present third embodiment, an optimal VI value is selected to maximize the efficiency of the screw compressor (1) according to the operation state of the refrigerant circuit, and the position of the slide valve (4) is thereby adjusted. Here, a control mechanism (not shown) controls the capacity by controlling the rotational frequency of the electric motor by an inverter, according to the operation state (a load on the utilization side).

The slide valve (4) is provided with a rotation block (not shown) in order that the inner circumferential surface of the slide valve (4) slides on the outer circumferential surface of a valve guide (15) wherever the position of the slide valve (4) is during the operation. Thus, the inner circumferential surface of the slide valve (4) is maintained in a position where the inner circumferential surface of the slide valve (4) and the inner circumferential surface of the cylinder wall (31) of the casing (30) forms the same cylinder surface. Accordingly, in the present third embodiment, the slide valve (4) does not rotate, and the inner circumferential surface of the slide valve (4) does not interfere with the outer circumferential surface of the screw rotor (40).

On the other hand, the cylinder-side discharge opening (28) included the discharge opening (25) includes a main discharge port (28*a*) and auxiliary discharge ports (28*b*, 28*c*, 28*d*) as shown in FIG. 16(A)-FIG. 16(D). The shape of the opening of the main discharge port (28*a*) is determined according to the position of the slide valve (4) in the rated load operation state, and as shown in FIG. 16(A)-FIG. 16(D), the main discharge port (28*a*) is open in both of the rated load operation state and the part load operation state, without being closed by the slide valve (4), and allows a fluid to be discharged. The shapes of the openings of the auxiliary discharge ports (28*b*, 28*c*, 28*d*) are determined according to the position of the slide valve (4) in the part load operation state. The auxiliary discharge ports (28*b*, 28*c*, 28*d*) are closed by the slide valve (4) in the rated load operation state, and are opened from the slide valve (4) in the part load operation state to allow a fluid to be discharged.

In the present third embodiment, a plurality of ports corresponding to a plurality of part load operation states are provided as the auxiliary discharge ports (28*b*, 28*c*, 28*d*). Specifically, the auxiliary discharge ports (28*b*, 28*c*, 28*d*) are three ports which correspond to the operation states of a 75% load factor, a 50% load factor, and a 25% load factor. The main discharge port (28*a*) and the auxiliary discharge ports (28*b*, 28*c*, 28*d*) are separated from one another. Further, the auxiliary discharge ports (28*b*, 28*c*, 28*d*) are provided on the suction side with respect to the main discharge port (28*a*).

FIG. 16(A)-FIG. 16(D) show the positional relationships between the slide valve (4) and the cylinder-side discharge opening (28), with the screw rotor (40) developed. The auxiliary discharge port (28*b*) (referred to as a first auxiliary discharge port (28*b*)) which corresponds to the operation state of a 75% load is provided at a location at which the auxiliary discharge port (28*b*) is closed by the slide valve (4) in the rated load operation state as shown FIG. 16(A), and is open in the operation states of a 75% load, a 50% load, and a 25% load as shown in FIG. 16(B)-FIG. 16(D). The auxiliary discharge port (28*c*) (referred to as a second auxiliary discharge port (28*c*)) which corresponds to the operation state of a 50% load is provided at a location at which the auxiliary discharge port (28*c*) is closed by the slide valve (4) in the rated load operation state and the operation state of a 75% load as shown in FIG. 16(A) and FIG. 16(B), and is open in the operation states of a 50% load and a 25% load as shown in FIG. 16(C) and FIG. 16(D). Further, the auxiliary discharge port (28*d*) (referred to as a third auxiliary discharge port (28*d*)) which corresponds to the operation state of a 25% load is provided at a location at which the auxiliary discharge port (28*d*) is closed by slide valve (4) in the rated load operation state and the operation states of a 75% load and a 50% load as shown in FIG. 16(A)-FIG. 16(C), and is open in the operation state of a 25% load as shown in FIG. 16(D).

The discharge side end surface (4*a*) of the slide valve (4) is configured to incline in a direction corresponding to the inclination of the helical groove (41) at the discharge side of the slide valve (4) in the part load operation state. Specifically, the inclination of the discharge side end surface (4*a*) of the slide valve (4) is decided based on the inclination of the helical groove in the operation state of a load of 50% or more and 75% or less as shown in FIG. 16(B) and FIG. 16(C) (this inclination corresponds to a line segment P'Q' between the points P' and Q' which are the projection of two points P and Q located at corners of the discharge side end surface (4*a*) of the slide valve (4) shown in FIG. 16(B) and FIG. 16(C), on the suction side edge of the screw land (42) in a direction perpendicular to the axis). Thus, when the screw rotor (40) is rotated and the line segment P'Q' comes to the position of the discharge side end surface (4*a*) of the slide valve (4), the line segment P'Q' coincides with the line segment PQ. Further, the side surfaces of the auxiliary discharge ports (28*b*, 28*c*, 28*d*) are tilted to align with the inclination of the discharge side end surface (4*a*) of the slide valve (4).

The width of each of the auxiliary discharge ports (28*b*, 28*c*, 28*d*) is narrower than the width of the land (referred to as a land width of the screw) of the portion of the helical groove (41) (the portion corresponding to the line segment. P'Q') based on which the inclination of the discharge side end surface (4*a*) of the slide valve (4) is decided. Further, the widths of the plurality of auxiliary discharge ports (28*b*, 28*c*, 28*d*) are reduced sequentially from the discharge side to the suction side. The widths of the auxiliary discharge ports (28*b*, 28*c*, 28*d*) are reduced from the discharge side to the suction side in accordance with the land width corresponding to the discharge side of the slide valve (4), the land width being reduced from the discharge side to the suction side within the range of movement of the slide valve (4) as shown in FIG. 16(A)-FIG. 16(D).

The reason why the three auxiliary discharge ports (28*b*, 28*c*, 28*d*) corresponding to the 75% load, the 50% load, and the 25% load are provided in addition to the main discharge port (28*a*) corresponding to the rated load operation state will be described below.

First, an annual performance factor is known as a coefficient of performance (COP) of a refrigeration apparatus. The annual performance factor is an annual COP obtained by weighting COPs in various load operations because there are heavy load operation periods, light load operation periods, middle load operation periods, etc., within a year. The annual performance factor includes, for example, an integrated part load value (IPLV) defined by Air-Conditioning and Refrigeration Institute. The IPLV is defined by the following formula.

$$IPLV=0.01A+0.42B+0.45C+0.12D$$

where A is a COP at a rated (100%) load; B is a COP at a load factor of 75%; C is a COP at a load factor of 50%; and D is a COP at a load factor of 25%. This means that if the IPLVs of all the targeted chillers are averaged, 45% of annual operation time is an operation at a load factor of 50%; 42% of annual operation time is an operation at a load factor of 75%; 12% of annual operation time is an operation at a load factor of 25%; and 1% of annual operation time is an operation at a load factor of 100%.

The weighting values may be slightly different between the US and Japan, but it is still important to place importance on COPs part load operations. Titus, it is preferable to increase operational efficiency the part load operation. According to the third embodiment, the area of the cylinder-side discharge opening (28) becomes large when the slide valve (4) is located at a position of the part load operation state, thereby reducing a discharge resistance and preventing a reduction in efficiency due to pressure loss in the part load operation state. As a result, the annual performance factor can be improved.

—Working Mechanism—Working mechanisms of the compression mechanism (20) and the variable VI mechanism (3) of the screw compressor (1) will be described.

<Compression Mechanism>

Figure 17:
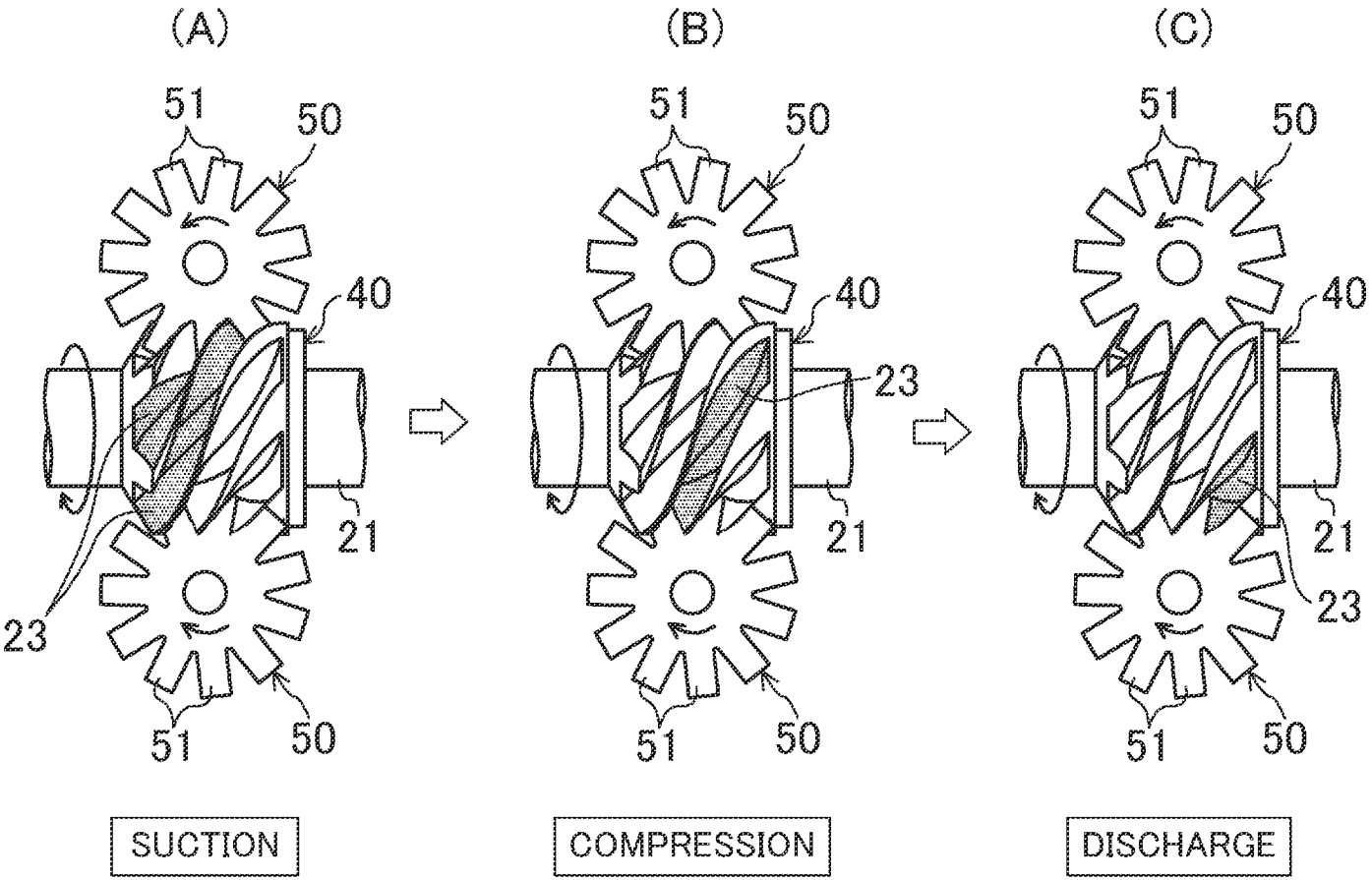
FIG. 17 shows plan views illustrating working mechanisms of a compression mechanism of the screw compressor.

When the electric motor is activated, the drive shaft (21) is rotated to rotate the screw rotor (40). As the screw rotor (40) is rotated, the gate rotors (50) are also rotated, and a suction phase, a compression phase, and a discharge phase of the compression mechanism (20) are repeated. In the following description, the compression chamber (23) which is shaded in FIG. 17 will be described.

In FIG. 17(A), the shaded compression chamber (23) communicates with the suction space (S1). The helical groove (41) constituting the compression chamber (23) meshes with the gates (51) of the lower gate rotor (50) shown in FIG. 7(A). When the screw rotor (40) is rotated, the gate (51) relatively moves toward the terminal end of the helical groove (41), thereby increasing the volume of the compression chamber (23). Thus, the low-pressure gas refrigerant in the suction space (S1) is sucked into the compression chamber (23) through the suction opening (24).

When the screw rotor (40) is further rotated, the compression chamber (23) is in the state shown in FIG. 17(B). As shown in FIG. 17(B), the shaded compression chamber (23) is completely closed. Thus, the helical groove (41) constituting the compression chamber (23) meshes with the gate (51) of the upper gate rotor (50) shown in FIG. 17(B), and is separated from the suction space (S1) by the gate (51). When the gate (51) moves toward the terminal end of the helical grooves (41) as the screw rotor (40) is rotated, the volume of the compression chamber (23) gradually decreases. Thus, the gas refrigerant in the compression chamber (23) is compressed.

When the screw rotor (40) is further rotated, the compression chamber (23) is in the state shown in FIG. 17(C). In FIG. 17(C), the shaded compression chamber (23) communicates with the discharge space (S2) through the discharge opening (25). When the gate (51) moves toward the terminal end of the helical groove (41) as the screw rotor (40) is rotated, the compressed refrigerant gas is pushed out of the compression chamber (23) to the discharge space (S2).

<Variable VI Mechanism (Volume Ratio Adjusting Mechanism)>

Next, an operation of the variable VI mechanism (3) will be described.

As described above, when the slide valve (4) slides to adjust the operating capacity of the screw compressor (1), the discharge start position at the discharge opening (25) is changed. As a result, the size of the discharge opening (25) is changed, and a terminal position of a compression phase (or a start position of a discharge phase) is changed.

FIG. 11 shows the state in which the slide valve (4) slides to the right. In this state, the discharge opening (25) is open at a location almost near the terminal end of the helical groove (41). This state is a high VI operation state which corresponds to the rated load operation of the refrigeration apparatus. This state of the screw compressor (1) is a state in which discharge is performed at the latest timing, and the compression ratio is the largest.

FIG. 12 shows the state in which the slide valve (4) slides to the left. In this state, the discharge opening (25) is open at a location near the middle of the helical groove (41). This state is a low VI operation state which corresponds to the part load operation of the refrigeration apparatus. In this state, discharge is performed earlier than the discharge performed in the high VI operation state (see FIG. 11), and the compression ratio is smaller than the compression ratio in the high VI operation state.

Here, in the state shown in FIG. 16(A) in which the slide valve (4) is located at a position corresponding to the rated load operation state, all the three auxiliary discharge ports (28*b*, 28*c*, 28*d*) are closed by the slide valve (4), and the main discharge port (28*a*) is open without being closed by the slide valve (4). The refrigerant compressed in the compression chamber (23) flows out to the discharge space (S2) through the main discharge port (28*a*).

In the state shown in FIG. 16(B) in which the slide valve (4) is located at a position corresponding to the operation state of a 75% load, the second auxiliary discharge port (28*c*) and the third auxiliary discharge port (28*d*) are closed by the slide valve (4), and the main discharge port (28*a*) and the first auxiliary discharge port (28*b*) are open without being closed by the slide valve (4). The refrigerant compressed in the compression chamber (23) flows out to the discharge space (S2) through the main discharge port (28*a*) and the first auxiliary discharge port (28*b*).

In the state shown in FIG. 16(C) in which the slide valve (4) is located at a position corresponding to the operation state of a 50% load, the third auxiliary discharge port (28*d*) is closed by the slide valve (4), and the main discharge port (28*a*), the first auxiliary discharge port (28*b*), and the second auxiliary discharge port (28*c*) are open without being dosed by the slide valve (4). The refrigerant compressed in the compression chamber (23) flows out to the discharge space (S2) through the main discharge port (28*a*), the first auxiliary discharge port (28*b*), and the second auxiliary discharge port (28*c*).

In the state shown in FIG. 16(D) in which the slide valve (4) is located at a position corresponding to the operation state of a 25% load, all of the main discharge port (28*a*), the first auxiliary discharge port (28*b*), the second auxiliary discharge port (28*c*), and the third auxiliary discharge port (28*d*) are open without being closed by the slide valve (4). The refrigerant compressed in the compression chamber (23) flows out to the discharge space (S2) through the main discharge port (28*a*), the first auxiliary discharge port (28*b*), the second auxiliary discharge port (28*c*), and the third auxiliary discharge port (28*d*).

In the present third embodiment, the refrigerant is discharged not only from the main discharge port (28*a*), but also from the corresponding auxiliary discharge ports (28*b*, 28*c*, 28*d*) in all of the plurality of part load operation states. Thus, the discharge resistance is reduced, and as a result, the pressure loss is reduced. Further, the refrigerant is discharged from only the main discharge port (28*a*) in the rated load operation state.

In the present third embodiment, the discharge side end surface (4*a*) of the slide valve (4) is inclined to correspond to the inclination of the helical groove (41) at the discharge side of the slide valve (4) in the part load operation state (i.e., the inclination of the line segment P'Q'). If the discharge side end surface (4*a*) of the slide valve (4) is inclined to correspond to the inclination of the helical groove (41) at the discharge side of the slide valve (4) in the rated load operation state (see the phantom line in FIG. 16(A)), it may result in communication between the adjacent compression chambers (23) in the part load operation state as shown in the phantom line in FIG. 16(D) because the inclination is steep. If such communication occurs, an intended compression ratio cannot be obtained. In the present third embodiment, the inclination of the slide valve (4) is determined so as to correspond to the inclination of the helical groove (41) in the part load state. The inclination of the helical groove (41) in the rated load operation state is steeper than the inclination of the helical groove (41) in the part load operation state. Therefore, in the present third embodiment, the adjacent helical grooves (41) (i.e., the compression chambers (23)) do not communicate with each other in all the operation states.

In the present third embodiment, the side surfaces of the auxiliary discharge ports (28*b*, 28*c*, 28*d*) are tilted. Further, the widths of the auxiliary discharge ports (28*h*, 28*c*, 28*d*) are sequentially reduced from the discharge side to the suction side, that is, from the first auxiliary discharge port (28*b*) to the third auxiliary discharge port (28*d*), and are narrower than the land width of the screw corresponding to each of the part load operations. Therefore, it is possible to more reliably prevent the adjacent helical grooves (41) (i.e., the compression chambers (23)) from communicating with each other when the auxiliary discharge ports (28*b*, 28*c*, 28*d*) are open without being closed by the slide valve (4).

—Advantages of Third Embodiment—

According to the present third embodiment, the provision of the auxiliary discharge ports (28*b*, 28*c*, 28*d*) in addition to the main discharge port (28*a*) enables a reduction in pressure loss due to a discharge resistance of the refrigerant in the part load operation. Thus, the operational efficiency in the part load operation is increased, which results in improvement in the annual performance factor. Further, the refrigerant is discharged only from the main discharge port (28*a*) in the rated load operation state, and adjacent compression chambers (23) do not communicate with each other. Thus, a problem in which an intended compression ratio cannot be obtained does not occur.

Further, the discharge side end surface (4*a*) of the slide valve (4) is inclined to correspond to the inclination of the helical groove at the discharge side of the slide valve (4) in the part load operation state. Thus, it is possible to prevent the adjacent helical grooves (i.e., the compression chambers (23)) from communicating with each other during operation. Moreover, since the width and the inclination of each of the auxiliary discharge ports (28*b*, 28*c*, 28*d*) are determined as described above, communication between adjacent helical grooves (i.e., the compression chambers (23)) can be prevented more reliably.

Specifically, because the inclination of the helical groove (41) corresponding to the position of the slide valve (4) in the part load operation is less steep than the inclination of the helical groove (41) corresponding to the position of the slide valve (4) in the rated load operation, the discharge side end surface (4*a*) of the slide valve (4) has a gentle inclination, and each of the side surfaces of the auxiliary discharge ports (28*b*, 28*c*, 28*d*) has a gentle inclination, as well. If this inclination is steep, the adjacent compression chambers (23) may communicate with each other. However, the inclination is gentle in the third embodiment, and thus, communication between the adjacent compression chambers (23) can be reliably prevented. Thus, a problem in which an intended compression ratio cannot be obtained does not occur.

In the third embodiment, the widths of the auxiliary discharge ports (28*b*, 28*c*, 28*d*) are narrower than the width of the land width of the screw. The width of the land which corresponds to the discharge side of the slide valve (4) is reduced from the discharge side to the suction side in the range of movement of the slide valve (4), and according to this reduction of the width of the land, the widths of the auxiliary discharge ports (28*b*, 28*c*, 28*d*) are reduced sequentially from the discharge side to the suction side. Thus, the auxiliary discharge ports (28*b*, 28*c*, 28*d*) do not intersect with the land, and adjacent compression chambers (23) (i.e., the helical grooves (41)) do not communicate with each other. Therefore, it is possible to reliably prevent a problem in which an intended compression ratio cannot be obtained.

<<Other Examples of Third Embodiment>>

The third embodiment may have the following structures.

For example, three auxiliary discharge ports (28*b*, 28*c*, 28*d*) are provided in addition to the main discharge port (28*a*) in the third embodiment, but only two auxiliary 110 discharge ports (28*b*, 28*c*) corresponding to the 75% load and 50% load operation states may be provided. Further, in some cases, one auxiliary discharge port may be provided, or four or more auxiliary discharge ports may be provided. In these cases, the part load percentage is not limited to 75%, 50%, and 25%, but may be appropriately changed.

The discharge resistance can be further reduced if the width of the main discharge port (28*a*) increased toward the suction side to a position corresponding to the point P of the discharge side end surface (4*a*), which is a position when the slide valve (4) is located to correspond to the rated load operation, as shown in phantom line in FIG. 16(A).

In the third embodiment, the auxiliary discharge ports (28*b*, 28*c*, 28*d*) are provided only under the slide valve in FIG. 16(A)-FIG. 16(D), but may be provided both under and above the slide valve as indicated by phantom line in FIG. 16(A). If the auxiliary discharge ports (28*b*, 28*c*, 28*d*) are provided both under and above the slide valve, the area of the discharge opening in the part load operation can be further increased. Thus, it is possible to reduce the pressure loss at the time of discharge of a refrigerant more effectively.

The foregoing embodiments are merely preferred examples in nature, and are not intended to limit the scope, applications, and use of the invention.

Industrial Applicability

As described above, the present invention is useful for a single-screw compressor having a variable VI mechanism (a volume ratio adjusting mechanism) for adjusting a ratio between a suction volume and a discharge volume.

What is claimed is:

1. A single-screw compressor, comprising:

a screw rotor including a helical groove formed in an outer circumferential surface of the screw rotor, a first end of the helical groove serving as a suction side of a fluid and a second end of the helical groove serving as a discharge side of the fluid;

a cylinder wall with the screw rotor rotatably accommodated within the cylinder wall;

a driving mechanism arranged and configured to drive the screw rotor at a variable rotational speed according to a load; and a slide valve provided in a slide groove, the slide groove being formed in the cylinder wall, the slide valve facing the outer circumferential surface of the screw rotor and being arranged and configured to be movable in an axial direction, and to adjust a discharge start position by moving in the axial direction in accordance with the rotational speed, wherein a portion of a land of the screw rotor to which portion a discharge side end of the slide valve faces in an operation of a predetermined part load that is lighter than a rated load, is defined as a facing portion, the discharge side end of the slide valve is in a shape circumferentially along the facing portion, as viewed radially, the cylinder wall is provided with a discharge opening which communicates, at a discharge side of the screw rotor, with a compression chamber formed in the helical groove of the screw rotor, the discharge opening includes a main discharge port having an opening shape that is determined according to a position of the slide valve in a state of operation of the rated load, and the main discharge port being open in both of the state of operation of the rated load and a state of operation of the part load, without being closed by the slide valve, and allowing the fluid to be discharged, and an auxiliary discharge port having an opening shape that is determined according to the position of the slide valve in the state of operation of the part load auxiliary discharge port being closed by the slide valve in the state of operation of the rated load, and opened from the slide valve in the state of operation of the part load and allowing the fluid to be discharged, and the auxiliary discharge port includes a plurality of auxiliary discharge ports corresponding to states of operation of a plurality of part loads.

2. The single-screw compressor of claim 1, wherein the operation of the predetermined part load is an operation state of a load factor of 50% or more and 75% or less.

3. The single-screw compressor of claim 2, wherein the discharge side end of the slide valve is in a shape along a suction side edge of the facing portion.

4. The single-screw compressor of claim 3, wherein the discharge side end of the slide valve has a curved surface along a suction side edge of the facing portion.

5. The single-screw compressor of claim 1, wherein the discharge side end of the slide valve is in a shape along a narrow portion of the land of the screw rotor at which the land has a narrowest width.

* * * * *